US006839046B1

(12) United States Patent
Orisaka et al.

(10) Patent No.: US 6,839,046 B1
(45) Date of Patent: Jan. 4, 2005

(54) DISPLAY DRIVING DEVICE AND MANUFACTURING METHOD THEREOF AND LIQUID CRYSTAL MODULE EMPLOYING THE SAME

(75) Inventors: Yukihisa Orisaka, Yamatotakada (JP); Yoshinori Ogawa, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/458,714

(22) Filed: Dec. 13, 1999

(30) Foreign Application Priority Data

Dec. 16, 1998 (JP) ..... 10-357970
Sep. 10, 1999 (JP) ..... 11-257555

(51) Int. Cl.[7] ..... G09G 3/36
(52) U.S. Cl. ..... 345/98; 345/99; 345/100
(58) Field of Search ..... 345/98, 99, 100, 345/204

(56) References Cited

U.S. PATENT DOCUMENTS 5,325,411 A 6/1994 Orisaka
5,739,887 A * 4/1998 Ueda et al. ..... 349/149
5,828,357 A 10/1998 Tamai
5,838,412 A * 11/1998 Ueda et al. ..... 349/150
6,002,384 A 12/1999 Tamai et al.
6,147,667 A * 11/2000 Yamazaki et al. ..... 345/92
6,232,939 B1 * 5/2001 Saito et al. ..... 345/100
6,232,941 B1 * 5/2001 Ode et al. ..... 345/210

FOREIGN PATENT DOCUMENTS

JP 8-329696 A 12/1996

* cited by examiner

*Primary Examiner*—Bipin Shalwala
*Assistant Examiner*—David L Lewis
(74) *Attorney, Agent, or Firm*—Birch, Stewart, Kolasch & Birch, LLP

(57) ABSTRACT

A gate driver mounted on a TCP is mounted on a print substrate. The input/output terminal, input terminal, and power terminal of the gate driver at one end of a group of gate drivers are connected to a controller by this mount, and a clock signal, select signal, and power voltage are transferred in a direction of the gate drivers. Meanwhile, the input terminal of a gate driver at the other end of the group of gate drivers is connected to the controller, and a start pulse signal is transferred in a direction of the gate drivers. As a result, it is possible to provide a display driving device in which a start pulse signal is fed in at a correct timing, a manufacturing method thereof, and a liquid crystal module employing such a display driving device.

24 Claims, 25 Drawing Sheets

DISPLAY DRIVING DEVICE AND MANUFACTURING METHOD THEREOF AND LIQUID CRYSTAL MODULE EMPLOYING THE SAME

FIELD OF THE INVENTION

The present invention relates to a driving device for driving a display element for image display, and in particular to a connection mode and signal supplied mode of liquid crystal drivers installed as gate drivers and source drivers in a liquid crystal module.

BACKGROUND OF THE INVENTION

The following will describe a conventional TFT-LCD module (liquid crystal module) referring to FIG. 18. A TFT-LCD module 501 of FIG. 18 is composed of a group of gate drivers (gate electrode drive circuit) 530, a group of source drivers (source electrode drive circuit) 540, a liquid crystal panel 550, a controller 510, and a liquid crystal power circuit 520.

The group of gate drivers 530 is composed of m gate drivers G1, G2, . . . , and Gm, which are LSI (Large Scale Integrated Circuit) chips of multiple outputs for driving gate bus lines of the liquid crystal panel 550. Each gate driver is mounded on a TCP (Tape Carrier Package) composed of copper foil wiring which is patterned with small intervals on an insulating film called a tape carrier to be described later and a sealing resin provided for the purpose of fixing and guarding the LSI chips.

The group of source drivers 540 is composed of n source drivers S1, S2, . . . , and Sn, which are LSI chips of multiple outputs for driving source bus lines of the liquid crystal panel 550. As with the group of gate drivers G1, G2, . . . , and G3, each source driver is also mounted on the TCP.

The liquid crystal panel 550 can be indicated by an equivalent circuit as shown in FIG. 19. As shown in FIG. 19, the liquid crystal panel 550 is composed of pixels which are disposed in matrix over a liquid crystal layer and TFTs (Thin Film Transistors) for driving the pixels. To the gate electrodes of the TFTs are connected gate bus lines provided in a horizontal direction, and to the source electrodes are connected source bus lines provided in a vertical direction. On the pixel side, electrodes connected to drain electrodes of the TFT constitute display electrodes, and the electrodes which face the display electrodes via the liquid crystal layer constitute common electrodes with respect to all pixels. Between the display electrodes and the gate bus lines is provided an auxiliary capacity.

When a forward voltage is applied to the gate electrodes of the TFTs (usually this is carried out from the group of gate electrodes 530 via gate bus lines), the TFTs are turned ON, and by the voltage applied to the source electrodes (usually this is carried out from the group of source drivers 540 via source bus lines), the liquid crystal load capacity provided between the gate electrodes and common electrodes is charged. When a reverse voltage is applied to the gate electrodes, the TFTs are turned OFF, and the voltage which had been applied to the source bus lines until this point is maintained in the liquid crystal load capacity.

In this manner, by controlling the gate voltage by way of applying a voltage to be written on the source electrodes, the pixels can be maintained at a predetermined voltage. The transmittance of the liquid crystal layer is changed in accordance with this maintained voltage, and as shown in FIG. 20, image display is carried out by projecting light from a backlight on the back side of the liquid crystal layer and by passing the light through a color filter.

The controller 510 carries out a timing control of a scan pulse generated on the group of gate drivers 530 and of a drive control signal on the group of source drivers 540, using as a base an external synchronize signal (from a host system), and supplies timing signals for the group of gate drivers 530, such as a start pulse signal $SP_G$ and a clock signal $CL_G$, and timing signals for the group of source drivers 540, such as a start pulse signal $SP_D$ and a clock signal $CL_D$. The liquid crystal power circuit 520 is powered by an external power source to supply power or data suitable for the group of gate drivers 530, group of source drivers 540, and the common electrodes of the liquid crystal panel 550, and supplies power source voltages VDD, VCC, and GND, and a video signal VIDEO as an analog video signal.

The following describes the group of gate drivers 530 in more detail referring to FIG. 21 and FIG. 22.

As shown in FIG. 21, the group of gate drivers 530 includes gate drivers G1, G2, . . . , and Gm which are serially connected to each other while being mounted on TCPg1, g2, . . . , and gm, respectively, and makes an electrical connection between the liquid crystal panel 550 and a print substrate. The outer lead terminals of the TCP, which are to be on the input side of the liquid crystal panel 550, are connected to the print substrate, and the outer lead terminals on the output side are connected to the liquid crystal panel 550. Here, FIG. 21 shows the controller 510 as it includes the liquid crystal power circuit 520, and the controller 510 supplies signals to the group of gate drivers 530 generally in a direction from a gate driver at one end of the group of gate drivers 530 to a gate driver at the other end with respect to all signals. Namely, in FIG. 21, the connection mode is such that the input/output terminals SP1, CL1, input terminal RL1, and power terminals VDD1, VCC1, and GND1 of the gate driver G1 of the group of gate drivers 530 are connected to the controller 510, and all signals are first inputted to the gate driver G1, and the output is then inputted to the gate driver G2, and the signals are sequentially supplied to the gate driver Gm one after another, and the signal transfer is carried out using wiring on the print substrate, wiring on the TCP, and internal wiring of each gate driver.

FIG. 22 is a circuit block diagram of one of the gate drivers. Note that, the gate drivers G1, G2, . . . , and Gm all have the same structure and FIG. 22 only shows an arrangement of a single gate driver. The gate driver includes a bidirectional shift register circuit 561, a level shifter circuit 562, an output circuit 563, SP input/output buffers SB1, SB2, CL input/output buffers CB1 and CB2, an inverter 564, input/output terminals SP1, SP2, CL1, CL2, input terminals RL1 and RL2, power terminals VDD1, VDD2, VCC1, VCC2, GND1, GND2, and output terminals Y1, Y2, . . . , and Yi. The following describes the function of each block.

The bidirectional shift register circuit (transfer circuit) 561 includes, for example, a plurality of latch circuits LAT1, LAT2, . . . , and LATi which are serially connected to each other, and carries out a shift operation, by the clock signal $CL_G$ to be a horizontal synchronize signal and to be used for the gate drivers, for transferring the start pulse signal $SP_G$ which is to be used for the gate drivers and which is generated from a vertical synchronize signal in a direction from a latch circuit LAT1, via a latch circuit LAT2, and onto a latch circuit LATi, or in a direction from the latch circuit LATi, via a latch circuit LAT(i−1), and onto the latch circuit LAT1. Each of the latch circuits LAT1, LAT2, . . . , and LATi serially outputs, at the timing of the shift operation, a selection pulse (source of drive signal) for selecting a pixel on the liquid crystal panel 550 which is driven by a voltage outputted from the group of source drivers 540.

The level shifter circuit 562 is composed of a plurality of level shifter stages (generation stages) LS1, LS2, . . . , and LSi, and receives selection pulses outputted from the corresponding latch circuits LAT1, LAT2, . . . , and LATi, and converts the voltage level to a voltage level required for turning ON or OFF the TFTs to send the output to the output circuit 563. The output circuit 563 is composed of a plurality of output stages (generation stages) OC1, OC2, . . . , and OCi, and takes in signals outputted from the corresponding level shifter stages LS1, LS2, . . . , and LSi for amplification by the internal buffers, and outputs the signals to the gate bus lines from output terminals Y1, Y2, . . . , and Yi. The outputs from the output circuit 563 are pulse signals, and such pulse signals will be called a gate pulse.

As described, the bidirectional shift register circuit 561 is capable of carrying out a switching operation of shift directions, and the switching operation is carried out by the select signal $RL_G$ to be supplied to the input terminal RL1 or RL2. The following describes the switching operation of shift directions by the bidirectional shift register 561.

When the start pulse signal $SP_G$ is to be shifted in a direction from the latch circuit LAT1, via the latch circuit LAT2, and onto the latch circuit LATi within the bidirectional shift register 561, the input/output terminal SP1 acts as the input terminal, and the start pulse signal $SP_G$ inputted is supplied to the bidirectional shift register circuit 561 via the SP input/output buffer SB1. The SP input/output buffer SB1, when the select signal $RL_G$ takes one of the logic levels, is activated by a select signal/$RL_G$ ($RL_G$ bar) which is obtained as the select signal $RL_G$ is inverted by the inverter 564, and the SP input/output buffer SB1 comes to have the function of the input buffer. Here, the SP input/output buffer SB2 is activated by the select signal $RL_G$ of the above logic level, and comes to have the function of the output buffer.

Further, as with the start pulse signal $SP_G$, the clock signal $CL_G$ is also inputted while the input/output terminal CL1 operates as the input terminal, and is supplied to the bidirectional shift register circuit 561 via the CL input/output buffer CB1. The CL input/output buffer CB1, when the select signal $RL_G$ takes one of the logic levels, is activated by the select signal/$RL_G$ which is obtained as the select signal $RL_G$ is inverted by the inverter 564, and the CL input/output buffer CB1 comes to have the function of the input buffer. Here, the CL input/output buffer CB2 is activated by the select signal $RL_G$ of the above logic level, and comes to have the function of the output buffer.

When the SP input/output buffers SB1 and SB2 and CL input/output buffers CB1 and CB2 are activated, the bidirectional shift register circuit 561 of multiple stages of for example 40 stages (i=40) conducts the output of the latch circuit of each stage while subsequently shifting the start pulse signal $SP_G$ inputted from the input/output terminal SP1 in a direction from the latch circuit LAT1, via the latch circuit LAT2, and onto the latch circuit LAT40 in synchronization with the clock signal $CL_G$ inputted from the input/output terminal CL1. The signal outputted from the latch circuit LAT40 on the 40th stage is outputted as a cascade output signal SPGO to be the start pulse signal $SP_G$ of the gate driver on the next stage from the input/output terminal SP2 which acts as the output terminal via the SP input/output buffer SB2.

On the other hand, when the select signal $RL_G$ takes the other logic level, the shift direction of the bidirectional shift register circuit 561 is switched in a direction from the latch circuit LATi, via the latch circuit LAT(i−1), and onto the latch circuit LAT1, and the start pulse signal $SP_G$ is inputted from the input/output terminal SP2 acting as the input terminal, to be supplied to the bidirectional shift register circuit 561 via the SP input/output buffer B2 which acts as the input buffer. Here, the other SP input/output buffer SB1 acts as the output buffer. The clock signal $CL_G$, as with the start pulse signal $SP_G$, is also inputted from the input/output terminal CL2 acting as the input terminal, to be supplied to the bidirectional shift register circuit 561 via the CL input/output buffer CB2 which acts as the input buffer. Here, the CL input/output buffer CB1 acts as the output buffer.

When the signals are inputted from the input/output terminals SP2 and CL1, and the SP input/output buffers SB1 and SB2 and CL input/output buffers CB1 and CB2 activated, the bidirectional shift register circuit 561 of multiple stages of for example 40 stages (i=40) sequentially shifts the stage which conducts the output in a direction from the latch circuit 40, via the latch circuit LAT 39, and onto the latch circuit LAT1, and the signal outputted from the latch circuit LAT1 on the first stage is outputted as the cascade output signal SPGO to be the start pulse signal $SP_G$ of the gate driver of the next stage from the input/output terminal SP1 which acts as the output terminal via the SP input/output buffer SB1.

Thus, generally, the start pulse signal $SP_G$ is externally inputted only with respect to the gate driver on the first stage of the group of gate drivers 530 installed in the liquid crystal module 501, and to the other gate drivers is inputted the start pulse signal $SP_G$ which is generated by the cascade output signal SPGO which was extracted from the last stage of the bidirectional shift register circuit 561 of the gate driver of the preceding stage. The clock signal $CL_G$, as with the start pulse signal $SP_G$, is subsequently transferred to the gate drivers of the following stages one after another in the same direction as that of the start pulse signal $SP_G$.

Note that, in FIG. 22, the power terminals VDD1 and VDD2 are terminals, one of which is a terminal which receives an output voltage and the other is a terminal for supplying an output voltage to the gate driver of the next stage, and the power terminals VCC1 and VCC2 are terminals, one of which is a terminal which receives a drive voltage for the gate driver and the other is a terminal for supplying the drive voltage to the gate driver of the next stage, and power terminals GND1 and GND2 are terminals, one of which is a terminal which receives a GND potential and the other is a terminal for supplying the GND potential to the gate driver of the next stage.

The above described the gate drivers.

The following describes the source drivers constituting the group of source drivers 540. FIG. 23 is a circuit block diagram of one of the source drivers. Note that, the source drivers S1, S2, . . . , and Sm all have the same structure and FIG. 23 only shows an arrangement of a single source driver. The source driver includes a bidirectional shift register circuit 571, an output circuit 572, SP input/output buffers SB1', SB2', CL input/output buffers CB1' and CB2', an inverter 573, input/output terminals SP1', SP2', CL1', CL2', input terminals RL1' and RL2', video input terminal Video, power terminals VCC1', VCC2', GND1', GND2', and output terminals Y1', Y2', . . . , and Yi'. The following describes the function of each block.

The bidirectional shift register circuit 571 includes a plurality of latch circuits LAT1', LAT2', . . . , and LATi' which are serially connected to each other as with the gate drivers, and carries out a shift operation by the clock signal $CL_D$ for transferring the start pulse signal $SP_D$ which is to be used for the source drivers in a direction from a latch circuit LAT1', via a latch circuit LAT2', and onto a latch circuit LATi', or in a direction from the latch circuit LATi', via a latch circuit LAT(i−1)', and onto the latch circuit LAT1'. Each of the latch circuits LAT1', LAT2', . . . , and LATi' serially outputs a sampling pulse (source of drive signal) for sampling an analog video signal to the output circuit 572.

The output circuit 572 is composed of a plurality of output stages (generation stages) OC1', OC2', . . . , and OCi', and samples the analog video signal inputted from the video input terminal Video based on sampling pulses outputted from the latch circuits LAT1', LAT2', . . . , and LATi'. The sampled signal is amplified by an amplifier circuit provided in the output circuit and is outputted from output terminals Y1', Y2', . . . , and Yi'.

As described, the bidirectional shift register circuit 571 is capable of carrying out a switching operation of shift directions as with the gate drivers, and the switching operation is carried out by the select signal $RL_D$ to be supplied to the input terminal RL1' or RL2'. The following describes the switching operation of shift directions by the bidirectional shift register 571.

When the start pulse signal $SP_D$ is to be shifted in a direction from the latch circuit LAT1', via the latch circuit LAT2', and onto latch circuit LATi' within the bidirectional shift register 571, the input/output terminal SP1' acts as the input terminal, and the start pulse signal $SP_D$ inputted is supplied to the bidirectional shift register circuit 571 via the SP input/output buffer SB1'. The SP input/output buffer SB1', when the select signal $RL_D$ takes one of the logic levels, is activated by a select signal/$RL_D$ ($RL_D$ bar) which is obtained as the select signal $RL_D$ is inverted by the inverter 573, and the SP input/output buffer SB1' comes to have the function of the input buffer. Here, the SP input/output buffer SB2' is activated by the select signal $RL_D$ of the above logic level, and comes to have the function of the output buffer.

Further, as with the start pulse signal $SP_D$, the clock signal $CL_D$ is also inputted from the input/output terminal CL1' which functions as the input terminal, and is supplied to the bidirectional shift register circuit 571 via the CL input/output buffer CB1'. The CL input/output buffer CB1', when the select signal $RL_D$ takes one of the logic levels, is activated by the select signal/$RL_D$ which is obtained as the select signal $RL_D$ is inverted by the inverter 573, and the CL input/output buffer CB1' comes to have the function of the input buffer. Here, the CL input/output buffer CB2' is activated by the select signal $RL_D$ of the above logic level, and comes to have the function of the output buffer.

When the SP input/output buffers SB1' and SB2' and CL input/output buffers CB1' and CB2' are activated, the bidirectional shift register circuit 571 of multiple stages of for example 40 stages (i=40) conducts the output of the latch circuit of each stage while subsequently shifting the start pulse signal $SP_D$ inputted from the input/output terminal SP1' in a direction from the latch circuit LAT1', latch circuit LAT2', to the latch circuit LAT40' in synchronization with the clock signal $CL_D$ inputted from the input/output terminal CL1'. The signal outputted from the latch circuit LAT40' on the 40th stage is outputted as a cascade output signal SPGO to be the start pulse signal $SP_D$ of the source driver on the next stage from the input/output terminal SP2' which acts as the output terminal via the SP input/output buffer SB2'.

On the other hand, when the select signal $RL_D$ takes the other logic level, the shift direction of the bidirectional shift register circuit 571 is switched in a direction from the latch circuit LATi', via the latch circuit LAT(i−1)', and onto the latch circuit LAT1', and the start pulse signal $SP_D$ is inputted from the input/output terminal SP2' acting as the input terminal to be supplied to the bidirectional shift register circuit 571 via the SP input/output buffer SB2' which acts as the input buffer. Here, the other SP input/output buffer SB1' acts as the output buffer. The clock signal CLD, as with the start pulse signal $SP_D$, is also inputted from the input/output terminal CL2' acting as the input terminal, to be supplied to the bidirectional shift register circuit 571 via the CL input/output buffer CB2' which acts as the input buffer. Here, the CL input/output buffer CB1' acts as the output buffer.

When the signals are inputted from the input/output terminals SP2' and CL1', and the SP input/output buffers SB1' and SB2' and CL input/output buffers CB1' and CB2' activated, the bidirectional shift register circuit 571 of multiple stages of for example 40 stages (i=40) sequentially shifts the stage which conducts the output in a direction from the latch circuit LAT40', via the latch circuit LAT39', and onto the latch circuit LAT1', and the signal outputted from the latch circuit LAT1' on the first stage is outputted as the cascade output signal SPGO to be the start pulse signal $SP_D$ of the source driver of the next stage from the input/output terminal SP1' which acts as the output terminal via the SP input/output buffer SB1'.

Thus, generally, the start pulse signal $SP_D$ is externally inputted only with respect to the source driver on the first stage of the group of source drivers 540 installed in the liquid crystal module 501, and to the other source drivers is inputted the start pulse signal $SP_D$ which is generated by the cascade output signal SPGO which was extracted from the last stage of the bidirectional shift register circuit 571 of the source driver of the preceding stage. The clock signal $CL_D$, as with the start pulse signal $SP_D$, is subsequently transferred to the source drivers of the following stages one after another in the same direction as that of the start pulse signal $SP_D$.

Note that, in FIG. 23, the power terminals VCC1' and VCC2' are terminals, one of which is a terminal which receives a drive voltage for the source driver and the other is a terminal for supplying the drive voltage to the source driver of the next stage, and the power terminals GND1' and GND2' are terminals, one of which is a terminal which receives a GND potential and the other is a terminal for supplying the GND potential to the source driver of the next stage.

The above described the source drivers.

In the described prior art, the driver LSIs such as gate drivers and source drivers are serially connected to each other, and this causes malfunction of the liquid crystal driving to occur by the clock skew of the clock signals $CL_G$ and $CL_D$, which is generated before and after the input/output buffers CB1, CB2, CB1', and CB2'. The following describes this problem referring to FIG. 24 and FIG. 25.

FIG. 24 is a circuit block diagram showing a state in which the driver LSIs are serially connected to each other. The circuit block as shown in FIG. 24 may be applied to both the gate drivers and source drivers, and the structure may be regarded as the same for both types of drivers. As such, the driver LSIs are assumed to be the gate drivers and the connection shown here is of a gate driver Gk (k=1, 2, . . . , and m−1) and a gate driver G(k+1).

The bidirectional shift register circuit 561 of the gate driver Gk and gate driver G(k+1) is structured to have a state in which flip-flops of multiple stages from flip-flop F/F1 to flip-flop F/Fi are connected to each other as a latch circuit. In the bidirectional shift register 561 of the gate driver Gk, D terminal and Q terminal of adjacent flip-flops are connected to each other, and the Q terminal of the flip-flop F/Fi on the last stage extends outside via the SP input/output buffer SB1, and is connected to the D terminal of the flip-flop F/F1 on the first stage of the gate driver G(k+1) via the SP input/output buffer SB1.

The clock signal line CL in the gate driver Gk extends outside via the CL input/output buffer CB2, and is connected to the clock signal line in the gate driver G(k+1). The clock signal $CL_G$ is supplied to the CK terminals of the gate drivers Gk and G(k+1) and to the internal logic circuit from the clock signal lines.

The input/output mode of the SP input/output buffers SB1 and SB2 and CL input/output buffers CB1 and CB2 of the gate drivers Gk and G(k+1) is controlled by the select signal $RL_G$ so that the start pulse signal $SP_G$ and clock signal $CL_G$ are transferred from the gate driver Gk to gate driver G(k+1). FIG. 24 shows a state of buffer circuits under this control. Thus, the start pulse signal $SP_G$ is sequentially transferred from the flip-flop on the left side of the paper to the flip-flop on the right side in synchronization with the rise of the clock signal $CL_G$ supplied. Further, in this case, Q output of each flip-flop is also outputted to the level shifter circuit 562, and in the case where the driver LSIs are source drivers, the Q output is also outputted to the output circuit 572.

Here, it is assumed that the clock signal $CL_G$ in the gate driver Gk is signal CK1, the start pulse signal $SP_G$ inputted to D terminal of the flip-flop F/F(i−1) is signal D1, the start pulse signal $SP_G$ outputted from Q terminal of the flip-flop F/F(i−1) and inputted to D terminal of the flip-flop F/Fi is signal D2, the start pulse signal $SP_G$ outputted from Q terminal of the flip-flop F/Fi is signal D3, the clock signal $CL_G$ in the driver G(k+1) is signal CK2, the start pulse signal $SP_G$ inputted to D terminal of the flip-flop F/F1 is signal D4, and the start pulse signal $SP_G$ outputted from Q terminal of the flip-flop F/F1 and inputted to D terminal of the flip-flop F/F2 is signal D5.

Then, the timing chart of these signals can be represented as shown in FIG. 25. As shown in FIG. 25, the signal CK1 becomes the signal CK2 via the CL input/output buffers CB1 and CB2, and as a result the signal CK2 is delayed with respect to the signal CK1, and the signal D3 becomes the signal D4 via the SP input/output buffers SB2 and SB1, and as a result the signal D4 is delayed with respect to the signal D3.

Here, the delay time of the clock signal $CL_G$ becomes greater than the delay time of the start pulse signal $SP_G$ due to waveform rounding as induced by a large negative capacity of the clock signal line and due to the delay time of the buffer circuit with an enhanced driving ability. Thus, when the start pulse signal $SP_G$ transferred in synchronization with the rise of signal CK1 through the gate driver Gk is transferred at the rise of signal CK2 in the flip-flop F/F1 on the first stage, there occurs a timing shift of a latch by the delay time, and as shown in FIG. 25, the signal D5 is outputted at a timing with substantially one clock cycle earlier than the timing at which the signal D5 should be outputted. As a result, in the subsequent operation, the start pulse signal $SP_G$ is transferred while maintaining this incorrectness and there occurs malfunction of the liquid crystal module 501. This phenomenon also occurs in the source drivers having the same structure.

In general, a demand for increasing the number of pixels is strong to improve the display quality of the liquid crystal module, and in order to meet this demand, the number of stages of the bidirectional shift register of the driver LSI of a single chip is inevitably increased. As a result, increase in load capacity of the clock signal line further aggravates the waveform rounding and delay of the clock signal. Further, because the data signal and clock signal need to be made faster to keep up with the increased number of pixels, the timing control of these signals are becoming harder than ever. Further, to meet the demand of lower power consumption, it is essential that the drive voltage be reduced.

For these reasons, in timing control, there is a limit in conventional techniques in which the load capacity is reduced by micro technique, and in which the driving capacity of the input/output buffer circuit of the clock signal is enhanced to meet the demand of various conditions such as above required for the liquid crystal module, and such conventional techniques involve difficulty in design of mounting as a liquid crystal module.

SUMMARY OF THE INVENTION

It is an object of the present invention to provide a display driving device in which a start pulse signal is fed in at a correct timing, and to provide a manufacturing method thereof and a liquid crystal module employing such a display driving device.

In order to achieve the above object, a display driving device of the present invention includes a plurality of driving semiconductor elements which generate in multiple generation stages a drive signal for a display element for displaying an image, and which are serially connected to one another with respect to input and output terminals of a start pulse signal and a clock signal which are used to generate the drive signal, the plurality of drive semiconductor elements having a transfer circuit for serially transferring a signal to be a source of the drive signal to each of the multiple generation stages by transferring the start pulse signal in a direction from the input terminal to the output terminal in synchronization with the clock signal, and the plurality of driving semiconductor elements being provided with the input terminal and the output terminal so that the start pulse signal and the clock signal are transferred in reverse directions with respect to the plurality of driving semiconductor elements which are serially connected to one another.

In accordance with the invention, the input terminal and the output terminal are selectively provided for their respective start pulse signal and clock signal so that these signals are transferred in opposite directions with respect to the plurality of driving semiconductor elements which are serially connected to one another. Also, the input terminals of the start pulse signal and the clock signal, respectively, are provided with input buffers in accordance with the transfer directions of the respective signals, and the output terminals of the respective signals are provided with output buffers in accordance with the transfer directions of the respective signals.

Thus, when the start pulse signal is transferred to the driving semiconductor element on the following stage, the synchronize clock signal to be used for outputting a signal to be a source of the drive signal precedes the clock signal used in the driving semiconductor element of the preceding stage with respect to the start pulse signal by the phase difference which corresponds to the sum of transfer time of the input buffer of a single stage and the output buffer of a single stage and which corresponds to the delay time due to waveform rounding. As a result, the start pulse signal for-generating the drive signal is inputted at a correct timing and the liquid crystal module operates correctly.

A manufacturing method of a display driving device of the present invention is for manufacturing a display driving device which includes a plurality of driving semiconductor elements which generate in multiple generation stages a drive signal for a display element for displaying an image, and which are serially connected to one another with respect to input and output terminals of a start pulse signal and a clock signal which are used to generate the drive signal, the plurality of drive semiconductor elements having a transfer circuit for serially transferring a signal to be a source of the drive signal to each of the multiple generation stages by transferring the start pulse signal in a direction from the input terminal to the output terminal in synchronization with the clock signal, and the plurality of driving semiconductor elements being provided with the input terminal and the output terminal so that the start pulse signal and the clock signal are transferred in reverse directions with respect to the plurality of driving semiconductor elements which are serially connected to one another, the plurality of driving semiconductor elements further and each including a data circuit for directly outputting input data, a data input terminal and a data output terminal of the data circuit being serially connected to each other so that the data is transferred in a direction of the clock signal, and the start pulse signal being inputted to the data input terminal on a first stage of the plurality of driving semiconductor elements with respect to the transfer direction of the data, and the data output terminal on a last stage of the plurality of driving semiconductor elements with respect to the transfer direction of the data being connected to the input terminal of the start pulse signal on the last stage of the plurality of driving semiconductor elements, the plurality of driving semiconductor elements each being mounted on a tape carrier package having input side outer lead terminals used for the serial connection and output side outer lead terminals to be connected to the display element, and the data output terminals on a last stage of the plurality of driving semiconductor elements with respect to the transfer direction of the data being shorted by predetermined input side outer lead terminals on the tape carrier package, and in order to achieve the foregoing object, and the method includes the steps of:

forming wiring of the tape carrier package by shorting beforehand predetermined two input side outer lead terminals; and cutting a film so as to maintain the shorted portion of the tape carrier package on which the last stage of the plurality of driving semiconductor elements with respect to the transfer direction of the data is to be mounted, and cutting a film so as not to maintain the shorted portion of the tape carrier package on which other of the plurality of driving semiconductor elements is to be mounted.

In accordance with the invention, when mounting the driving semiconductor element on a tape carrier package to manufacture the above display driving device, wiring is formed by shorting beforehand predetermined two input side outer lead terminals with respect to all tape carrier packages. Then, a film is cut so as to maintain the shorted portion of the tape carrier package on which the last stage of the plurality of driving semiconductor elements with respect to the transfer direction of the data is to be mounted, and the remaining shorted portion can be used as a shorted portion between the input side outer lead terminal to be connected to the input terminal and the input side outer lead terminal to be connected to the input terminal of the start pulse signal. Further, a film is cut so as not to maintain the shorted portion of the tape carrier package on which other of the plurality of driving semiconductor elements is to be mounted, and predetermined adjacent input side outer lead terminals are electrically separated.

Thus, the same manufacturing steps can be used for all tape carrier packages up until the film cutting step, and the tape carrier package of the last stage and the other tape carrier packages can be separated from each other at the film cutting step, thereby efficiently manufacturing the above display driving device. Also, even when the arrangement of the input/output terminals of the driving semiconductor elements are altered, the tape carrier package can be manufactured only by changing the shorted portion, thus improving the degree of freedom of the serial connection.

Further, the display driving device of the present invention has an arrangement in which the display element is a liquid crystal panel to which the drive signal is supplied per pixel including a liquid crystal layer.

In accordance with the invention, the display driving device is provided as a group of gate drivers or a group of source drivers for driving pixels on the liquid crystal panel, thus accurately driving the liquid crystal panel.

For a fuller understanding of the nature and advantages of the invention, reference should be made to the ensuing detailed description taken in conjunction with the accompanying drawings.

DESCRIPTION OF THE EMBODIMENTS

First Embodiment

The following will describe one embodiment of a display driving device of the present invention and a liquid crystal module employing such a display driving device referring to FIG. 1 through FIG. 8. Note that, even though the following explanations are based on a group of gate drivers as an example of the display driving device, the features of such a group of gate drivers and the liquid crystal module employing it are obviously applicable to a group of source drivers as well.

Figure 1:
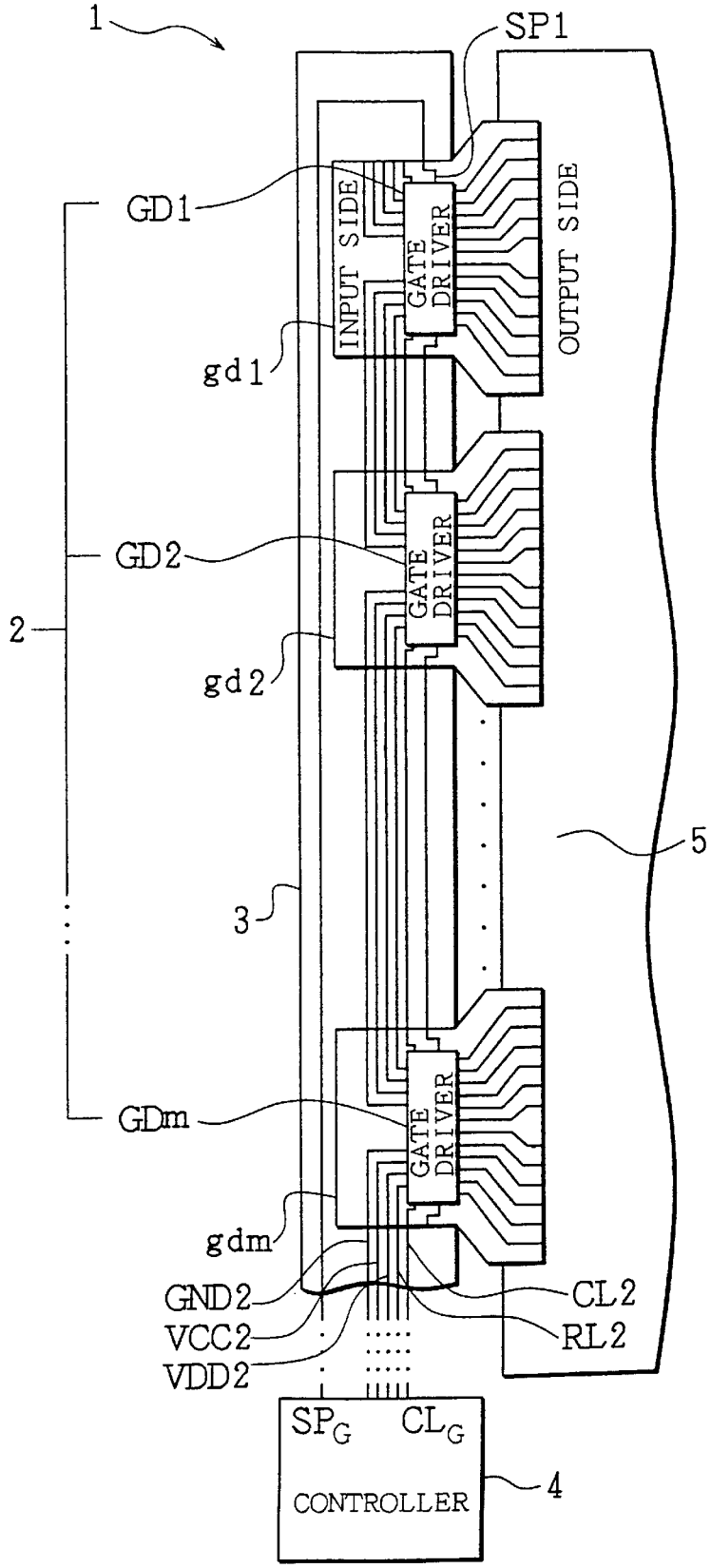
FIG. 1 is a plan view showing a structure of a liquid crystal module employing a group of gate drivers in accordance with one embodiment of the present invention.

FIG. 1 shows a structure of a liquid crystal module 1 of the present embodiment. The liquid crystal module 1 includes a group of gate drivers 2, a print substrate 3 bearing wiring for the group of gate drivers 2, a controller 4 for supplying a signal required for driving liquid crystal to the group of gate drivers 2, and a liquid crystal panel 5 which is driven by the group of gate drivers 2.

The group of gate drivers (display driving device) 2 is composed of m gate drivers (driving semiconductor elements) GD1, GD2, . . . , and GDm, which are LSI chips of multiple outputs for driving a gate bus line (not shown) of the liquid crystal panel (display element) 5. The gate drivers GD1, GD2, . . . , and GDm, while being mounted on TCPgd1, gd2, . . . , and gdm, respectively, are serially connected to one another through input/output terminals of various signals such as start pulse signal $SP_G$ and clock signal $CL_G$ which are supplied from the controller 4, so as to electrically connect the liquid crystal panel 5 and the print substrate 3. The outer lead terminals on the input side of each TCP, to be lead lines of the input/output terminals used for the serial connection are connected to the print substrate 3, and the outer lead terminals on the output side of each TCP are used as lead lines for the gate bus lines of a gate pulse (drive signal) outputted from each of the gate drivers GD1, GD2, . . . , and GDm so as to be connected to the liquid crystal panel 5.

Further, input/output terminal CL2, input terminal RL2, and power terminals VDD2, VCC2, and GND2 of the gate driver GDm at one end of the group of gate drivers 2 are connected to the controller 4 including a liquid crystal driving power circuit, and the clock signal $CL_G$, select signal $RL_G$, and power voltage are transferred toward the gate driver GD1 from the gate driver GDm. Meanwhile, input/output terminal SP1 of the gate driver GD1 at the other end of the group of gate drivers 2 is connected to the controller 4 by the wiring on the print substrate 3, and the start pulse $SP_G$ is transferred toward the gate driver GDm from the gate driver GD1. The feature of the present embodiment is that the start pulse signal $SP_G$ and the clock signal $CL_G$ are transferred in reverse directions with respect to the serial connection of the gate drivers. The following will describe this feature in more detail.

Figure 2:
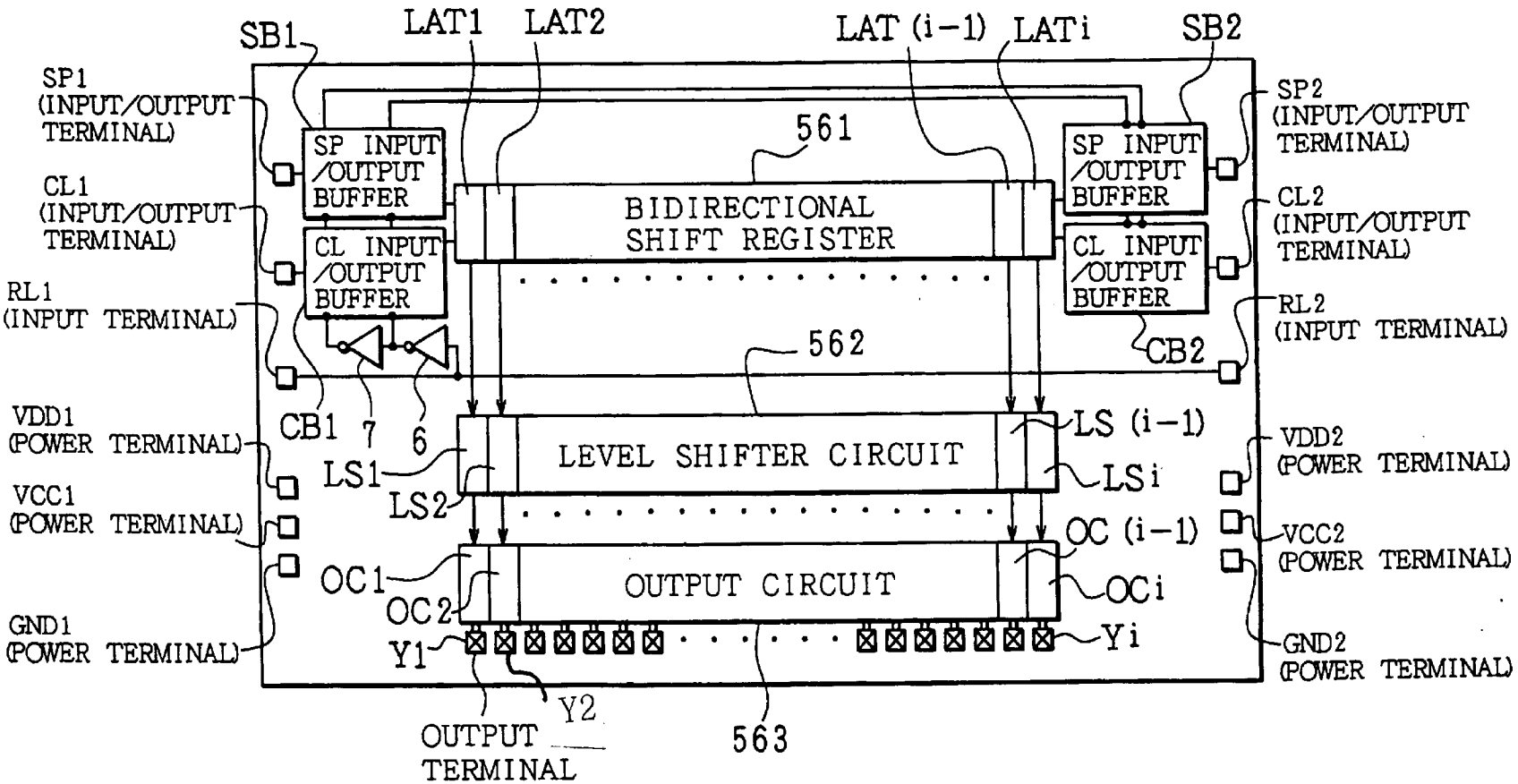
FIG. 2 is a block diagram showing a structure of each gate driver of the group of gate drivers of FIG. 1.

FIG. 2 shows a circuit block diagram of each gate driver. Note that, the gate drivers GD1, GD2, . . . , and GDm all have the same structure and FIG. 2 only shows a single gate driver. The gate driver includes a bidirectional shift register circuit 561, a level shifter circuit 562, an output circuit 563, SP input/output buffers SB1 and SB2, CL input/output buffers CB1 and CB2, inverters 6 and 7, input/output terminals SP1, SP2, CL1, and CL2, input terminals RL1 and RL2, power terminals VDD1, VDD2, VCC1, VCC2, GND1, and GND2, and output terminals Y1, Y2, . . . , and Yi.

The following describes a detailed structure and the function of each block except for the bidirectional shift register circuit 561, level shifter circuit 562, output circuit 563, input/output terminals SP1, SP2, CL1, and CL2, input terminals RL1 and RL2, power terminals VDD1, VDD2, VCC1, VCC2, GND1, and GND2, and output terminals Y1, Y2, . . . , and Yi, which are all known from the prior art.

The SP input/output buffers SB1 and SB2 and CL input/output buffers CB1 and CB2 are provided with the input/output terminals SP1, SP2, CL1, and CL2, respectively, and these buffers receive a select signal/$RL_G$ which is produced by the inverter 6 by inverting once the logic level of a select signal $RL_G$ inputted from the input terminal RL1 or RL2, and a signal which is produced by the inverter 7 by further inverting the logic level of the select signal/$RL_G$, i.e., the select signal $RL_G$. The functions of the SP input/output buffers SB1 and SB2 and CL input/output buffers CB1 and CB2 as input buffers and output buffers are switched by the combinations the logic levels of the select signal $RL_G$ and select signal/$RL_G$.

Figure 3:
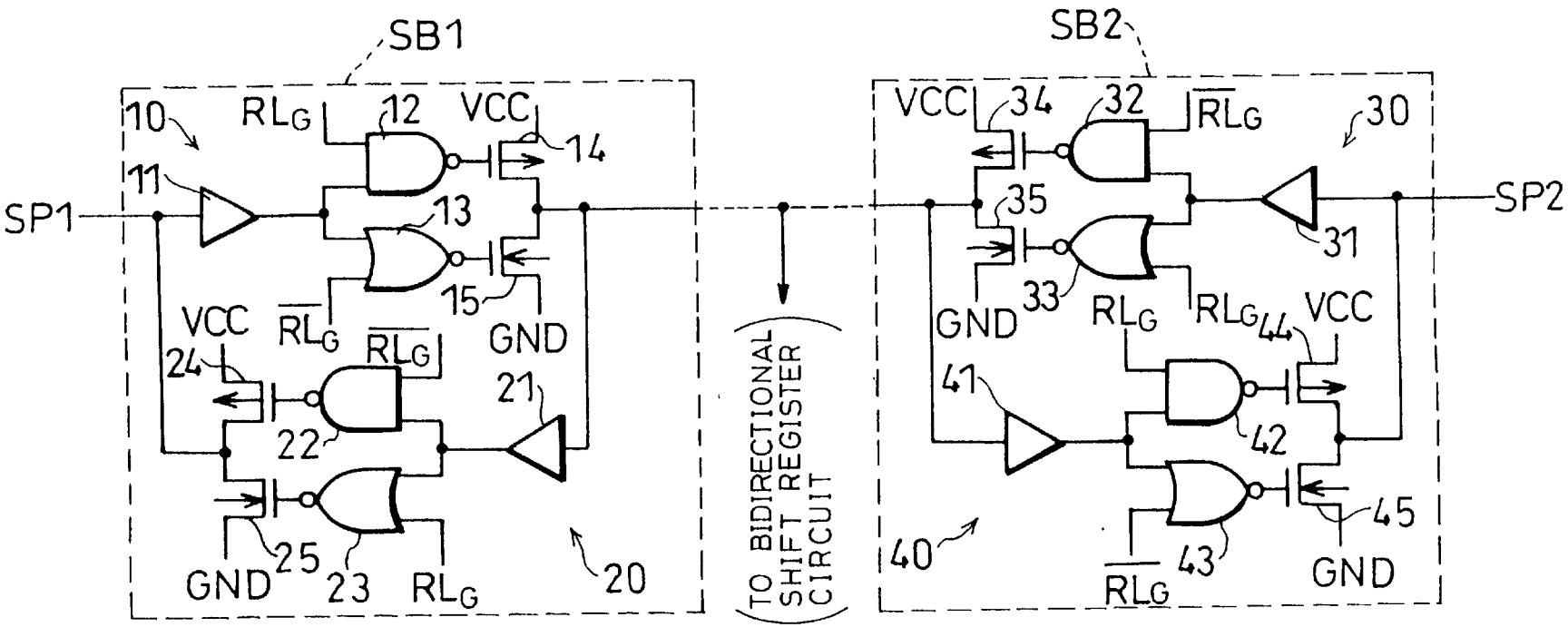
FIG. 3 is a circuit diagram showing a structure of SP input/output buffers of the gate driver of FIG. 2.

FIG. 3 shows specific circuit structures of the SP input/output buffers SB1 and SB2. The SP input/output buffer SB1 is composed of (a) an input buffer circuit 10 which includes a buffer 11, NAND gate 12, NOR gate 13, p channel MOSFET 14, and n channel MOSFET 15, and (b) an output buffer circuit 20 which includes a buffer 21, NAND gate 22, NOR gate 23, p channel MOSFET 24, and n channel MOSFET 25.

In the input buffer circuit 10, the input terminal of the buffer 11 is connected to the input/output terminal SP1, and the output terminal thereof is connected to one of the input terminals of the NAND gate 12 and to one of the input terminals of the NOR gate 13. The other input terminal of the NAND gate 12 is connected to the output terminal of the inverter 7 and the select signal $RL_G$ is inputted. The other input terminal of the NOR gate 13 is connected to the output terminal of the inverter 6 and the select signal/$RL_G$ is inputted. The output terminal of the NAND gate 12 is connected to the gate of the p channel MOSFET 14, and the output terminal of the NOR gate 13 is connected to the gate of the n channel MOSFET 15. The drain of the p channel MOSFET 14 is connected to the power terminal VCC2 and a "High" level potential VCC is maintained, and the source of the n channel MOSFET 15 is connected to the power terminal GND2 and a "Low" level potential GND is maintained. Further, the source of the p channel MOSFET 14 is connected to the drain of the n channel MOSFET 15, and the junction is connected to a latch circuit LAT 1 on the first stage of the bidirectional shift register 561.

In the output circuit 20, the input terminal of the buffer 21 is connected to the latch circuit LAT1 on the first stage of the bidirectional shift register 561, and the output terminal thereof is connected to one of the input terminals of the NAND gate 22 and to one of the input terminals of the NOR gate 23. The other input terminal of the NAND gate 22 is connected to the output terminal of the inverter 6 and the select signal/$RL_G$ is inputted, and the other input terminal of the NOR gate 23 is connected to the output terminal of the inverter 7 and the select signal $RL_G$ is inputted. The output terminal of the NAND gate 22 is connected to the gate of the p channel MOSFET 24, and the output terminal of the NOR gate 23 is connected to the gate of the n channel MOSFET 25.

The drain of the p channel MOSFET 24 is connected to the power terminal VCC2 and a "High" level potential VCC is maintained, and the source of the n channel MOSFET 25 is connected to the power terminal GND2 and a "Low" level potential GND is maintained. Further, the source of the p channel MOSFET 24 is connected to the drain of the n channel MOSFET 25, and the junction is connected to the input/output terminal SP1.

The SP input/output buffer SB2 is represented by the circuit on the right side of FIG. 3, and is composed of (a) an input buffer circuit 30 which includes a buffer 31, NAND gate 32, NOR gate 33, p channel MOSFET 34, and n channel MOSFET 35 and (b) an output buffer circuit 40 which includes a buffer 41, NAND gate 42, NOR gate 43, p channel MOSFET 44, and n channel MOSFET 45.

In the buffer circuit 30, the input terminal of the buffer 31 is connected to the input/output terminal SP2, and the output terminal thereof is connected to one of the input terminals of the NAND gate 32 and to one of the input terminals of the NOR gate 33. The other input terminal of the NAND gate 32 is connected to the output terminal of the inverter 6 and the select signal/$RL_G$ is inputted, and the other input terminal of the NOR gate 33 is connected to the output terminal of the inverter 7 and the select signal $RL_G$ is inputted. The output terminal of the NAND gate 32 is connected to the gate of the p channel MOSFET 34, and the output terminal of the NOR gate 33 is connected to the gate of the n channel MOSFET 35.

The drain of the p channel MOSFET 34 is connected to the power terminal VCC2 and a "High" level potential VCC is maintained, and the source of the n channel MOSFET 35 is connected to the power terminal GND2 and a "low" level potential GND is maintained. Further, the source of the p channel MOSFET 34 is connected to the drain of the n channel MOSFET 35 and the junction is connected to a latch circuit LATi on the last stage of the bidirectional shift register 561.

In the output buffer circuit 40, the input terminal of the buffer 41 is connected to the latch circuit LATi on the last stage of the bidirectional shift register 561, and the output terminal thereof is connected to one of the input terminals of the NAND gate 42 and to one of the input terminals of the NOR gate 43. The other input terminal of the NAND gate 42 is connected to the output terminal of the inverter 7 and the select signal $RL_G$ is inputted, and the other input terminal of the NOR gate 43 is connected to the output terminal of the inverter 6 and the select signal/$RL_G$ is inputted. The output terminal of the NAND gate 42 is connected to the gate of the p channel MOSFET 44, and the output terminal of the NOR gate 43 is connected to the gate of the n channel MOSFET 45.

Further, the drain of the p channel MOSFET 44 is connected to the power terminal VCC2 and a "High" level potential VCC is maintained, and the source of the n channel MOSFET 45 is connected to the power terminal GND2 and a "Low" level potential GND is maintained. Further, the source of the p channel MOSFET 44 is connected to the drain of the n channel MOSFET 45 and the junction is connected to the input/output terminal SP2.

In the SP input/output buffers SB1 and SB2 having the described structures, when the select signal $RL_G$ is at "High" level, in the SP input/output buffer SB1, one of the p channel MOSFET 24 and n channel MOSFET 25 of the output buffer circuit 20 will be in a high impedance state while the other is in an ON state, and both the p channel MOSFET 24 and N channel MOSFET 25 of the output buffer circuit 20 will be in a high impedance state, and as a result the SP input/output buffer SB1 operates as the input buffer. Here, in the same manner, the SP input/output buffer SB2 operates as the output buffer. When the select signal $RL_G$ is at "Low" level, the reverse operation will occur and the SP input/output buffer SB1 operates as the output buffer and the SP input/output buffer SB2 operates as the input buffer.

Figure 4:
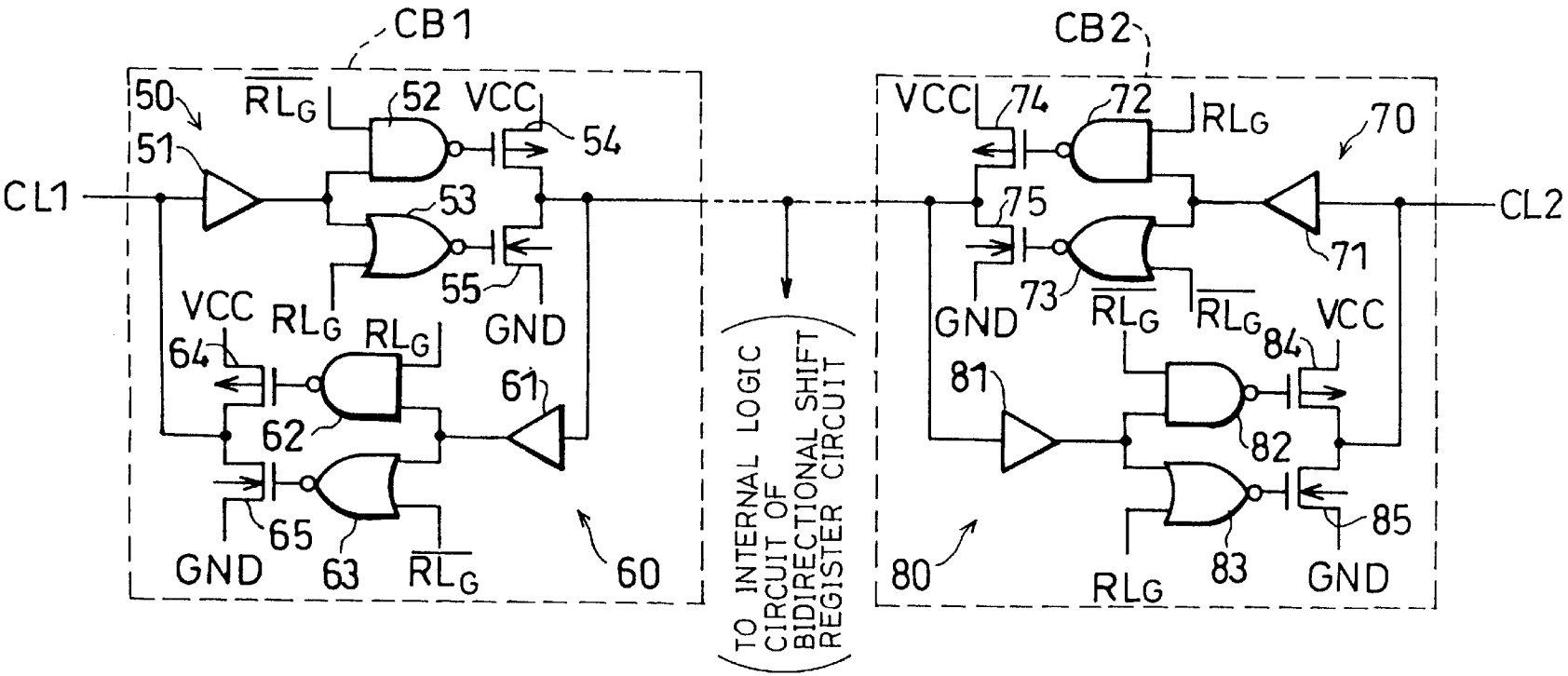
FIG. 4 is a circuit diagram showing a structure of CL input/output buffers of the gate driver of FIG. 2.

FIG. 4 shows specific circuit structures of the CL input/output buffers CB1 and CB2. The CL input/output buffer CB1 is composed of (a) an input buffer circuit 50 which includes a buffer 51, NAND gate 52, NOR gate 53, p channel MOSFET 54, and n channel MOSFET 55, and (b) an output buffer circuit 60 which includes a buffer 61, NAND gate 62, NOR gate 63, p channel MOSFET 64, and n channel MOSFET 65.

In the input buffer circuit 50, the input terminal of the buffer 51 is connected to the input/output terminal CL1, and the output terminal thereof is connected to one of the input terminals of the NAND gate 52 and to one of the input terminals of the NOR gate 53. The other input terminal of the NAND gate 52 is connected to the output terminal of the inverter 6 and the select signal/$RL_G$ is inputted, and the other input terminal of the NOR gate 53 is connected to the output terminal of the inverter 7 and the select signal $RL_G$ is inputted. The output terminal of the NAND gate 52 is connected to the gate of the p channel MOSFET 54, and the output terminal of the NOR gate 53 is connected to the gate of the n channel MOSFET 55.

The drain of the p channel MOSFET 54 is connected to the power terminal VCC2 and a "High" level potential VCC is maintained, and the source of the n channel MOSFET 55 is connected to the power terminal GND2 and a "Low" level potential GND is maintained. Further, the source of the p channel MOSFET 54 is connected to the drain of the n channel MOSFET 55, and the junction is connected o the latch circuit LAT 1 on the first stage of the bidirectional shift register 561 and to an internal logic circuit.

In the output buffer circuit 60, the input terminal of the buffer 61 is connected to the latch circuit LAT1 on the first stage of the bidirectional shift register 561 and to the internal logic circuit, and the output terminal thereof is connected to one of the input terminals of the NAND gate 62 and to one of the input terminals of the NOR gate 63. The other input terminal of the NAND gate 62 is connected to the output terminal of the inverter 7 and the select signal $RL_G$ is inputted, and the other input terminal of the NOR gate 63 is connected to the output terminal of the inverter 6 and the select signal/$RL_G$ is inputted. The output terminal of the NAND gate 62 is connected to the gate of the p channel MOSFET 64, and the output terminal of the NOR gate 63 is connected to the gate of the n channel MOSFET 65.

The drain of the p channel MOSFET 64 is connected to the power terminal VCC2 and a "High" level potential VCC is maintained, and the source of the n channel MOSFET 65 is connected to the power terminal GND2 and a "Low" level potential GND is maintained. Further, the source of the p channel MOSFET 64 is connected to the drain of the n channel MOSFET 65, and the junction is connected to the input/output terminal CL1.

The CL input/output buffer CB2 is composed of (a) an input buffer circuit 70 which includes a buffer 71, NAND gate 72, NOR gate 73, p channel MOSFET 74, and n channel MOSFET 75 and (b) an output buffer circuit 80 which includes a buffer 81, NAND gate 82, NOR gate 83, p channel MOSFET 84, and n channel MOSFET 85.

In the buffer circuit 70, the input terminal of the buffer 71 is connected to the input/output terminal CL2, and the output terminal thereof is connected to one of the input terminals of the NAND gate 72 and to one of the input terminals of the NOR gate 73. The other input terminal of the NAND gate 72 is connected to the output terminal of the inverter 7 and the select signal $RL_G$ is inputted, and the other input terminal of the NOR gate 73 is connected to the output terminal of the inverter 6 and the select signal/$RL_G$ is inputted. The output terminal of the NAND gate 72 is connected to the gate of the p channel MOSFET 74, and the output terminal of the NOR gate 73 is connected to the gate of the n channel MOSFET 75.

The drain of the p channel MOSFET 74 is connected to the power terminal VCC2 and a "High" level potential VCC is maintained, and the source of the n channel MOSFET 75 is connected to the power terminal GND2 and a "low" level potential GND is maintained. Further, the source of the p channel MOSFET 74 is connected to the drain of the n channel MOSFET 75 and the junction is connected to a latch circuit LATi on the last stage of the bidirectional shift register 561 and to the internal logic circuit.

In the output buffer circuit 80, the input terminal of the buffer 81 is connected to the latch circuit LATi on the last stage of the bidirectional shift register 561 and to the internal logic circuit, and the output terminal thereof is connected to one of the input terminals of the NAND gate 82 and to one of the input terminals of the NOR gate 83. The other input terminal of the NAND gate 82 is connected to the output terminal of the inverter 6 and the select signal/$RL_G$ is inputted, and the other input terminal of the NOR gate 83 is connected to the output terminal of the inverter 7 and the select signal $RL_G$ is inputted. The output terminal of the NAND gate 82 is connected to the gate of the p channel MOSFET 84, and the output terminal of the NOR gate 83 is connected to the gate of the n channel MOSFET 85.

Further, the drain of the p channel MOSFET 84 is connected to the power terminal VCC2 and a "High" level potential VCC is maintained, and the source of the n channel MOSFET 85 is connected to the power terminal GND2 and a "Low" level potential GND is maintained. Further, the source of the p channel MOSFET 84 is connected to the drain of the n channel MOSFET 85 and the junction is connected to the input/output terminal CL2.

In the CL input/output buffers CB1 and CB2 having the described structures, when the select signal $RL_G$ is at "Low" level, in the CL input/output buffer CB1, one of the p channel MOSFET 54 and n channel MOSFET 55 of the output buffer circuit 50 will be in a high impedance state while the other is in an ON state, and both the p channel MOSFET 64 and n channel MOSFET 65 of the output buffer circuit 60 will be in a high impedance state, and as a result the CL input/output buffer CB1 operates as the input buffer. Here, in the same manner, the CL input/output buffer CB2 operates as the output buffer. When the select signal $RL_G$ is at "High" level, the reverse operation will occur and the CL input/output buffer CB1 operates as the output buffer and the CL input/output buffer CB2 operates as the input buffer.

Table 1 shows the input/output mode of the SP input/output buffers SB1 and SB2 and CL input/output buffers CB1 and CB2 with respect to the logic level of the select signal $RL_G$.

TABLE 1

| | SELECT SIGNAL $RL_G$ | |
|---|---|---|
| INPUT/OUTPUT BUFFER | "LOW" | "HIGH" |
| SP INPUT/OUTPUT BUFFER SB1 | OUTPUT BUFFER | INPUT BUFFER |
| SP INPUT/OUTPUT BUFFER SB2 | INPUT BUFFER | OUTPUT BUFFER |
| CL INPUT/OUTPUT BUFFER CB1 | INPUT BUFFER | OUTPUT BUFFER |
| CL INPUT/OUTPUT BUFFER CB2 | OUTPUT BUFFER | INPUT BUFFER |

In this manner, by using the input/output buffers which can be switched to have input or output function, a circuit can be structured with ease with respect to setting of transfer directions of the start pulse signal $SP_G$ and the clock signal $CL_G$, which will be described later.

Also, by the same principle as that of the input/output buffers, the bidirectional shift register 561 may also have an arrangement wherein a group of flip-flops constituting a shift register are connected to each other in forward and reverse directions respectively in two circuits, and the group of flip-flops of either forward or reverse direction is selected by the select signal $RL_G$. Alternatively, a circuit for switching input and output, such as the input/output buffer, may be provided for each flip-flop.

Figure 5:
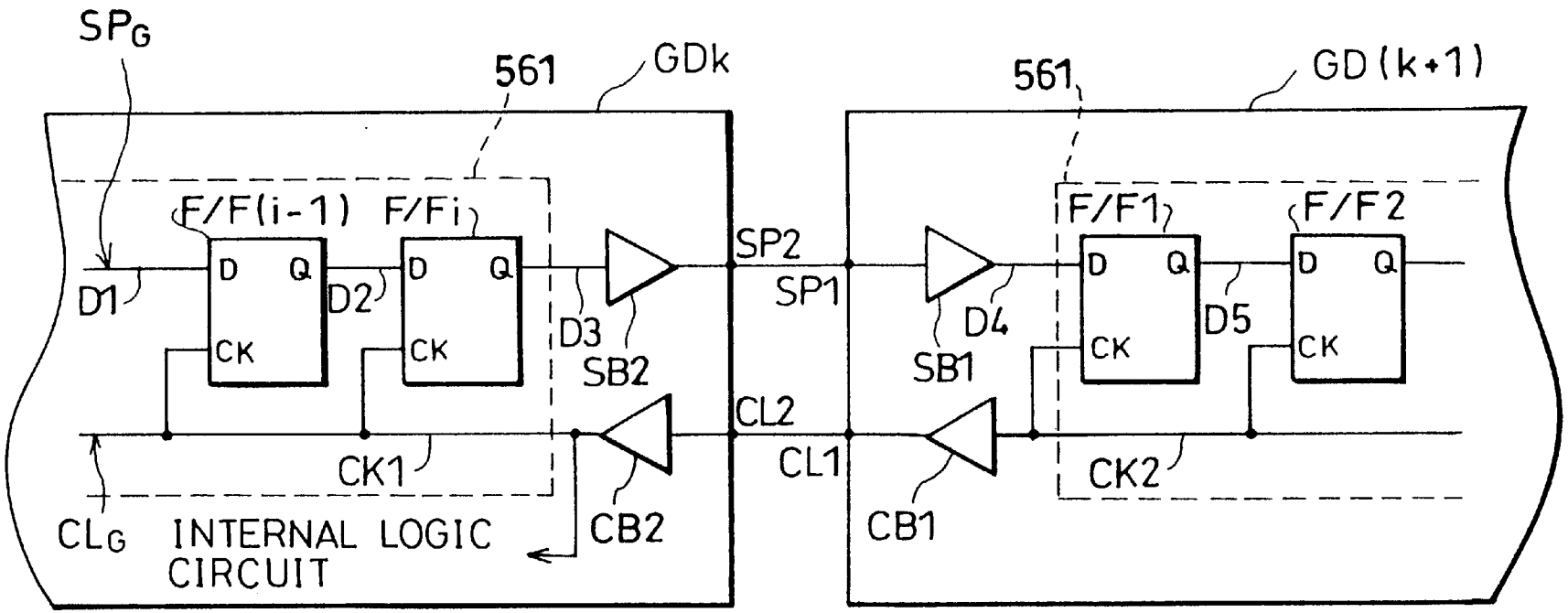
FIG. 5 is an explanatory drawing showing how a start pulse signal and a clock signal are transferred in the group of gate drivers of FIG. 1.
Figure 6:
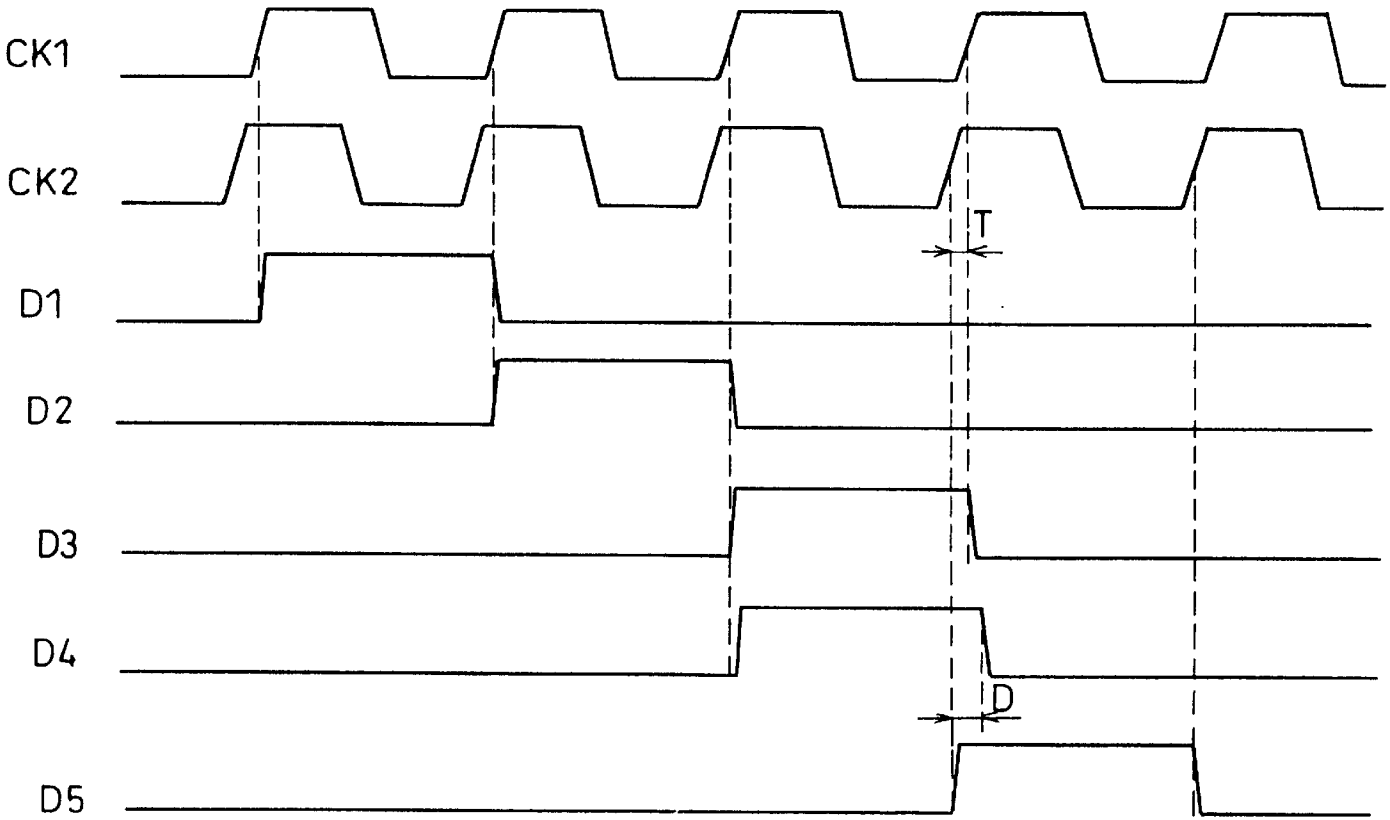
FIG. 6 is a timing chart showing a transfer process of the start pulse signal and the clock signal of the explanatory drawing of FIG. 5.

The following describes a transfer of the start pulse signal $SP_G$ and clock signal $CL_G$ in the group of shift drivers 2 having the described arrangement referring to FIG. 5 and FIG. 6.

FIG. 5 is a circuit block diagram showing a state in which a gate driver GDk (k=1, 2, . . . , m−1) and a gate driver GD(k+1) are serially connected to each other. In FIG. 5, the select signal $RL_G$ is set at "High" level so as to transfer the start pulse signal $SP_G$ in a direction from the gate driver GDk to the gate driver GD(k+1) and to transfer the clock signal $CL_G$ in a direction from the gate driver GD(k+1) to the gate driver GDk. Namely, the SP input/output buffer SB1 and the CL input/output buffer CB2 operate as the input buffers, and the SP input/output buffer SB2 and the CL input/output buffer CB1 operate as the output buffers. Accordingly, the input/output terminals SP1 and CL2 function as the input terminals, and the input/output terminals SP2 and CL1 function as the output terminals.

The bidirectional shift register circuit 561 of the gate drivers GDk and GD(k+1) includes multi-stage flip-flops of flip-flop F/F1 to flip-flop F/Fi which are connected to each other to constitute a latch circuit. In the bidirectional shift register circuit 561 of the gate driver GDk, D terminal and Q terminal of adjacent flip-flops are connected to each other, and the Q terminal of the flip-flop F/Fi on the last stage extends outward via the SP input/output buffer SB2 and the input/output terminal SP2 to be connected to D terminal of the flip-flop F/F1 on the first stage via the input/output terminal SP1 and SP input/output buffer SB1 of the gate driver GD(k+1).

The clock signal line inside the gate driver GD(k+1) extends outward via the CL input/output buffer CB1 and the input/output terminal CL1 to be connected to the clock signal line inside the gate driver GDk via the input/output terminal CL2 and the CL input/output buffer CB2. The clock signal $CL_G$ is supplied to the CK terminal of each flip-flop in the gate drivers GDk and GD(k+1) and to the internal logic circuit through the clock signal line. The start pulse signal $SP_G$ is sequentially transferred from the flip-flop on the left side to the flip-flop on the right side of FIG. 5 in synchronization with a rise of the clock signal $CL_G$ supplied. Further, in this case, the Q output of each flip-flop is also outputted to the level shifter circuit 562, and in the case where the driver LSI is the source driver, the Q output is also outputted to the output circuit 572.

Here, it is denoted that the clock signal $CL_G$ in the gate driver GDk is signal CK1, the start pulse signal $SP_G$ inputted to the D terminal of the flip-flop F/F(i−1) is signal D1, the start pulse signal $SP_G$ outputted from the Q terminal of the flip-flop F/F(i−1) and inputted to the D terminal of the flip-flop F/Fi is signal D2, the start pulse $SP_G$ outputted from the Q terminal of the flip-flop F/Fi is signal D3, the clock signal $CL_G$ inside the gate driver GD(k+1) is signal CK2, the start pulse signal $SP_G$ inputted to the D terminal of the flip-flop F/F1 is signal D4, and the start pulse signal $SP_G$ outputted from the Q terminal of the flip-flop F/F1 and inputted to the D terminal of the flip-flop F/F2 is signal D5.

Then, the timing chart of these signals can be represented as shown in FIG. 6. The signal CK2 becomes the signal CK1 via the CL input/output buffers CB1 and CB2, and by the transfer time and waveform rounding, the signal CK1 is delayed by time T (T>0) with respect to the signal CK2. That is, the signal CK2 precedes the signal CK1 by the phase difference which corresponds to time T. Thus, when signal D3 is supplied to the gate driver GD(k+1) as signal D4 which is slightly delayed from signal D3 by having being transferred through the SP input/output buffers SB2 and SB1, where signal D3 is a resultant signal of signals D1 and D2 which were latched and transferred in synchronization with a rise of the signal CK1, the flip-flop F/F1 latches the signal D4 by the signal CK2 which rises immediately before the signal D4 falls so as to output signal D5.

In this manner, by transferring the start pulse signal $SP_G$ and the clock signal $CL_G$ in reverse directions with respect to the serial connection of the gate drivers, the signal D5 can be outputted at a correct timing and the gate pulse generated based on this output is outputted to the gate bus line at a correct timing from the output circuit 563, and unlike the conventional example, there occurs no malfunction of the liquid crystal module 1. As a result, one can take a measure for increased number of pixels on a display screen, namely, it is possible to increase the number of stages of shift register circuits 561 in the gate drivers, and the speed of the clock signal $CL_G$, and the number of gate drivers.

Note that, between signals D4 and D5, there is an overlap of Time D as shown in FIG. 6, which is in the order of several tens of nano second. Thus, when a drive signal which was generated based on these signals is to be applied to the liquid crystal panel S via the output circuit 563, etc., as a gate pulse for the gate bus line, or alternatively as a voltage in accordance with display data for the drain bus line in the case of the source driver, the overlap time due to waveform rounding based on the capacity of the liquid crystal element is eliminated, and the TFT maintains the applied voltage for a duration of a sufficiently long single horizontal period, and thus the liquid crystal element is not adversely affected and the problem of impaired display quality does not occur.

Figure 7:
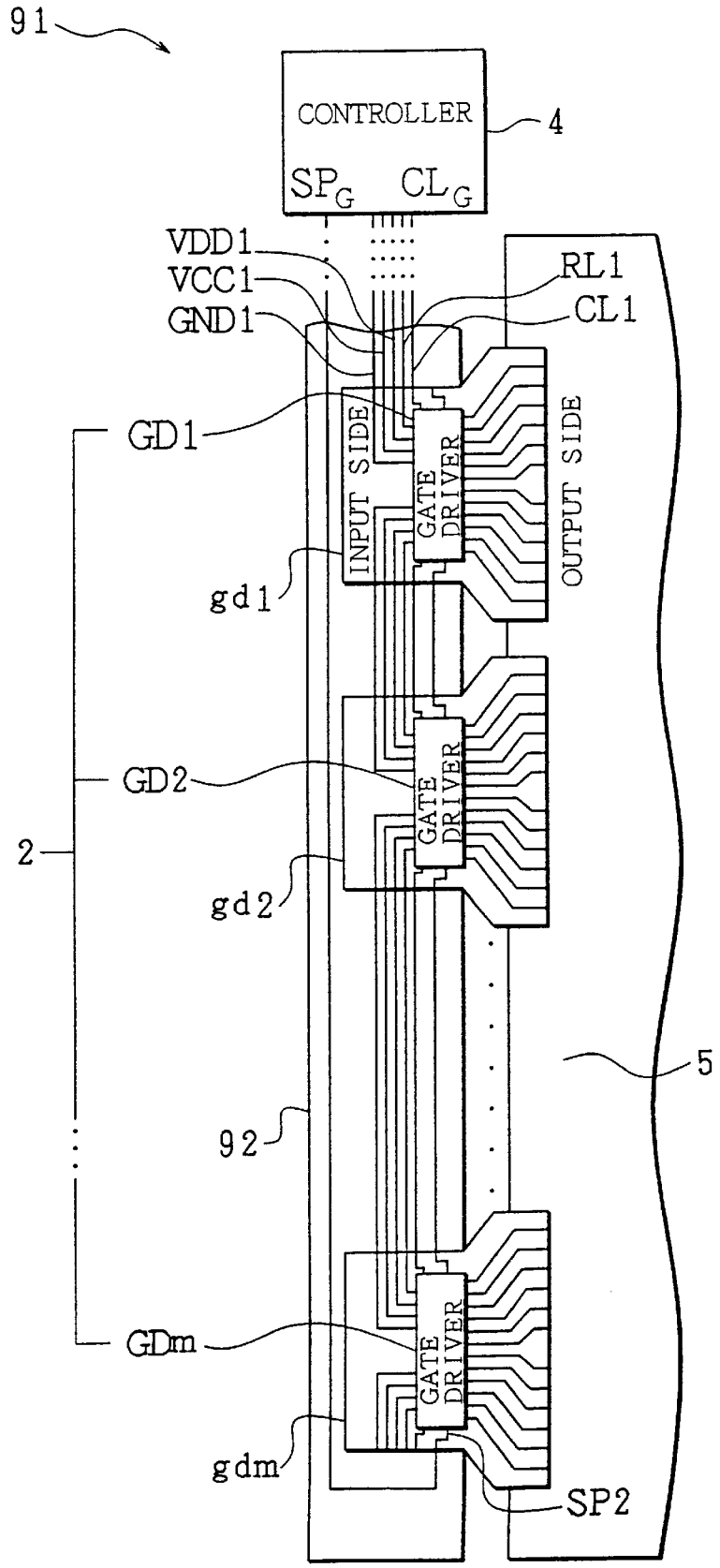
FIG. 7 is a plan view showing a modified structure of the liquid crystal module of FIG. 1.

In the described liquid crystal module 1, the start pulse signal $SP_G$ and clock signal $CL_G$ are transferred in a direction from the gate driver GD1 to the gate driver GDm and in a direction from the gate driver GDm to the gate driver GD1, respectively, in the group of gate drivers 2. However, as shown in FIG. 7, it is perfectly possible to have a liquid crystal module 91 having an arrangement wherein the start pulse signal $SP_G$ and clock signal $CL_G$ are transferred in the opposite directions from the above. directions in the group of gate drivers 2.

In such an arrangement, the input/output terminal SP2 of the gate driver GDm at one end of the group of gate drivers 2 is connected via wiring on a print substrate 92 to the controller 4 which is positioned on the side of the gate driver GD1, and to the controller 4 are also connected the input/output terminal CL1, input terminal RL1, and power terminals VDD1, VCC1, and GND1 of the gate driver GD1 at the other end of the group of gate drivers 2. Further, because the SP input/output buffers SB1 and SB2 and the CL input/output buffers CB1 and CB2 will be in the reverse operation of that in the liquid crystal module 1, the select signal $RL_G$ is set at "Low" level.

In this manner, with the use of the group of gate drivers 2 which can switch the transfer direction of signals, the controller 4 can be variably positioned.

Figure 8:
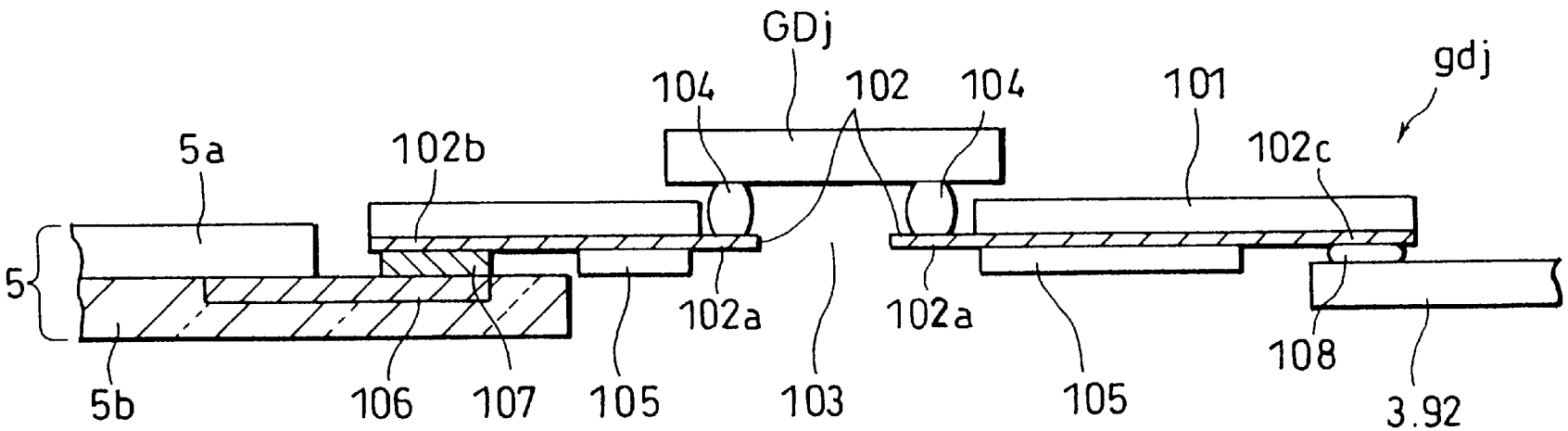
FIG. 8 is a cross sectional view explaining a mounted state of the liquid crystal module of FIG. 1 and FIG. 7.

The following describes how the gate driver is mounted on a TCP and also how a TCP is mounted on the liquid crystal module 1 or 91. FIG. 8 is a cross sectional view explaining the mount. Each input/output terminal of a gate driver GDj (j=1, 2, . . . , and m) having aluminium internal wiring is connected via a bump 104 to an inner lead terminal 102*a* which is a portion of Cu wiring 102 provided over a surface of a TCP substrate 101 made of an insulating film and which extends into a through hall 103. On the Cu wiring 102 is formed a solder resist 105. The gate driver GDj is mounted in this manner and a TCPgdj (j=1, 2, . . . , and m) having a flexible property is made.

The TCPgdj is mounted on the liquid crystal panel 5 by heat-bonding an outer lead 102*b* which is provided on the output side of the Cu wiring 102 of the TCPgdj, via ACF (Anisotropic Conductive Film) 107, onto a terminal 106 made of ITO (Indium Tin Oxide) provided on a lower glass 5*b* having a larger area than that of an upper glass 5*a*.

Further, the TCPgdj is mounted on a print substrate 3 or 92 by connecting an outer lead terminal 102*c* provided on the input side of the Cu wiring 102 of the TCPgdj to the wiring of the print substrate 3 or 92 using a solder 108. Note that, the ACF 107 may be used instead of the solder 108.

As described, the display driving device of the present embodiment includes a plurality of driving semiconductor elements which generate in multiple generation stages a drive signal for a display element for displaying an image, and which are serially connected to one another with respect to input and output terminals of a start pulse signal and a clock signal which are used to generate the drive signal, and the plurality of drive semiconductor elements have a transfer circuit for serially transferring a signal to be a source of the drive signal to each of the multiple generation stages by transferring the start pulse signal in a direction from the input terminal to the output terminal in synchronization with the clock signal, and the plurality of driving semiconductor elements are provided with the input terminal and the output terminal so that the start pulse signal and the clock signal are transferred in reverse directions with respect to the plurality of driving semiconductor elements which are serially connected to one another.

In this arrangement, it is preferable that the input terminal and the output terminal of the plurality of driving semiconductor elements are interchangeable with respect to each of the start pulse signal and the clock signal, and that the input terminal is provided with an input buffer for each of the start pulse signal and the clock signal, and the output terminal is provided with an output buffer for each of the start pulse signal and the clock signal.

It is further preferable that the input buffer and the output buffer are input/output buffers whose input and output are interchangeable in accordance with a select signal which is externally supplied.

Further, it is preferable that the input/output buffer of the start pulse signal and the input/output buffer of the clock signal are switched so that directions of input and output are reversed.

Second Embodiment

The following will describe another embodiment of the display driving device of the present invention and the liquid crystal module employing it referring to FIG. 9 through FIG. 17. Note that, for convenience of explanation, those constituting elements having the same functions as those described in FIG. 1 are given the same reference numerals and explanations thereof are omitted here. Also, even though the following explanation is based on a group of gate drivers as an example of the display driving device, as with the First Embodiment, the features of such a group of gate drivers and the liquid crystal module employing it are obviously applicable to a group of source drivers as well.

Figure 9:
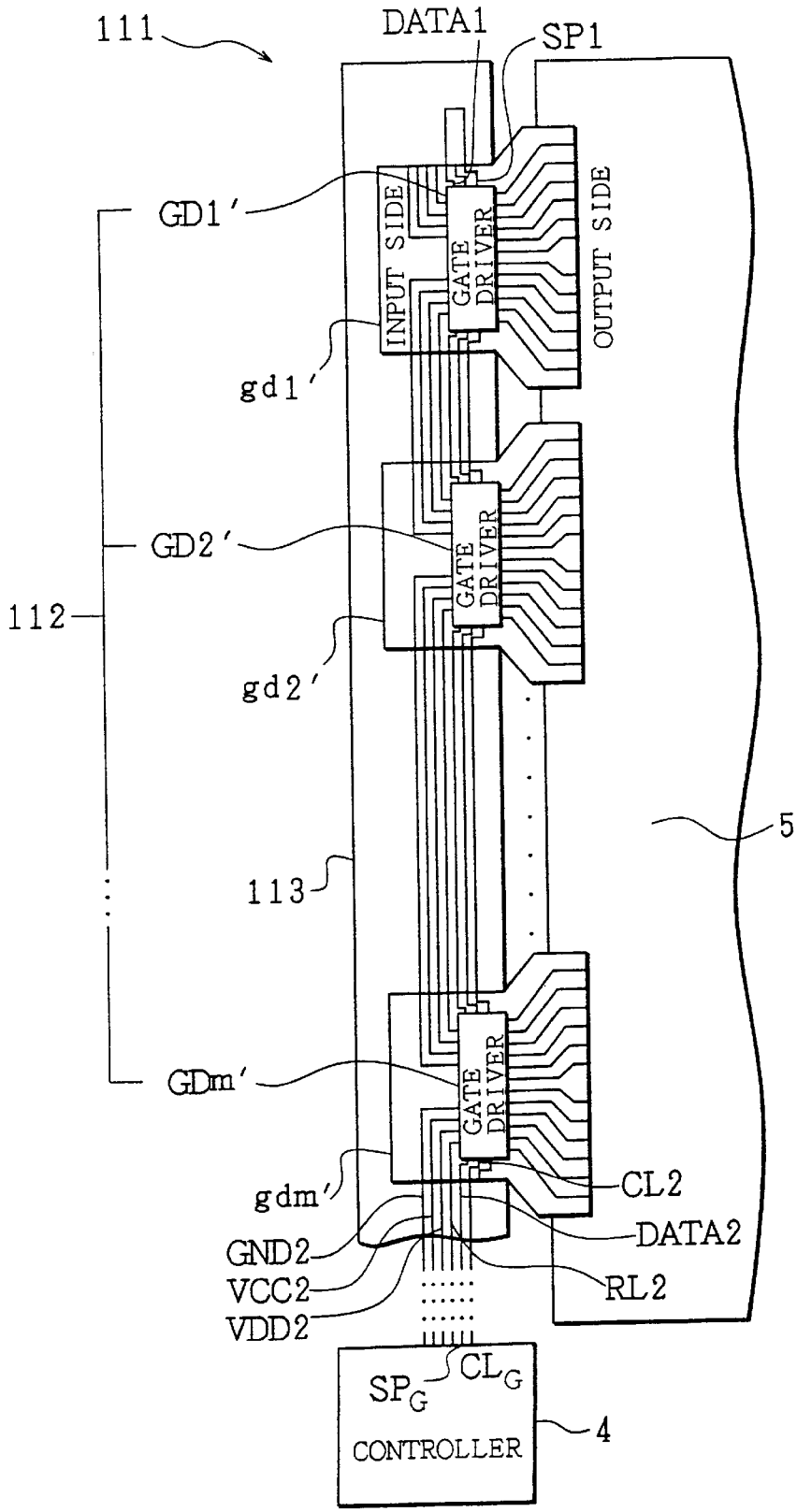
FIG. 9 is a plan view showing one example of a structure of a liquid crystal module employing a group gate drivers in accordance with another embodiment of the present invention.
Figure 10:
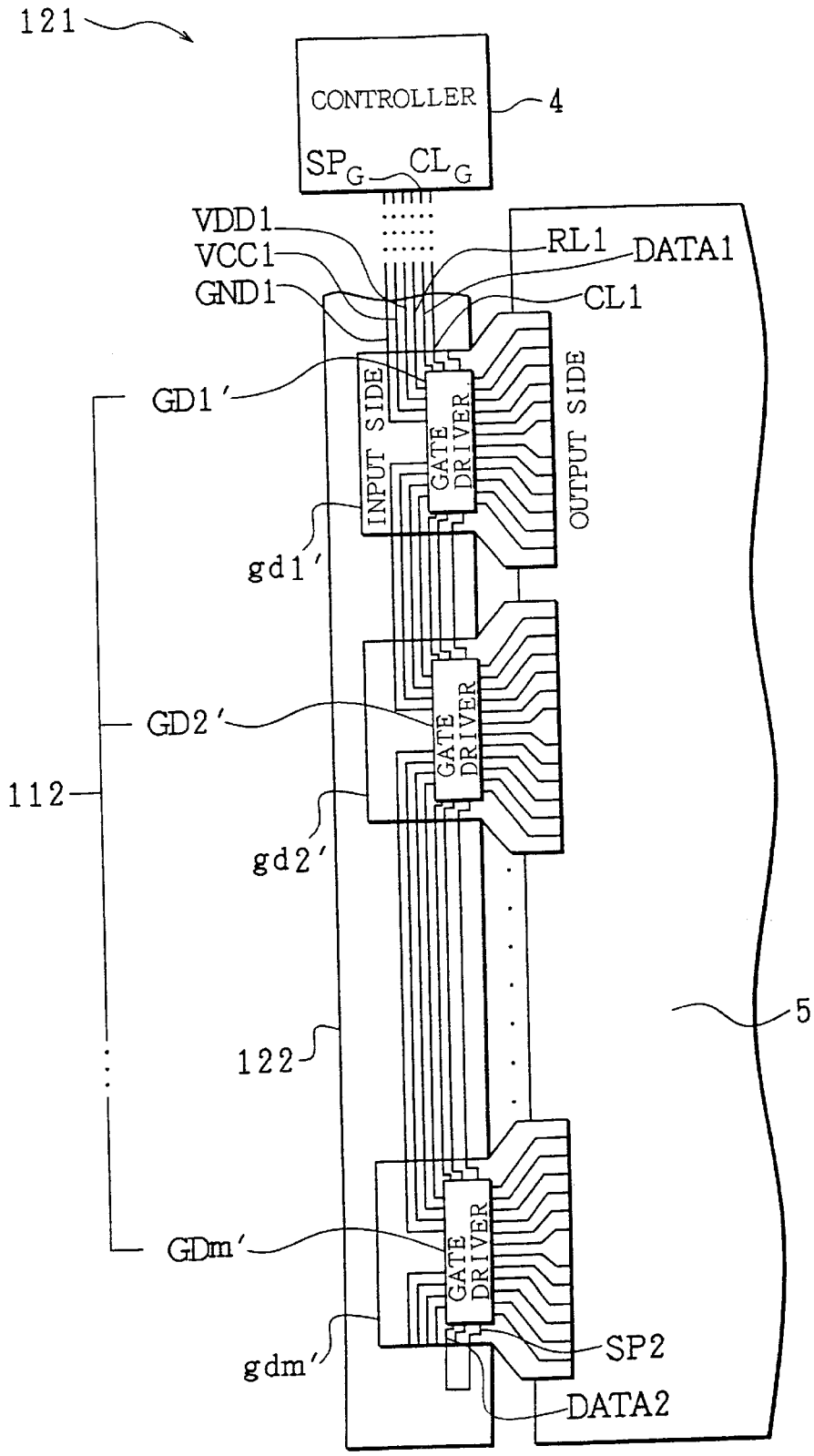
FIG. 10 is a plan view showing another example of a structure of a liquid crystal module employing a group gate drivers in accordance with another embodiment of the present invention.

FIG. 9 and FIG. 10 show the structures of liquid crystal modules 111 and 112 of the present embodiment, respectively. Unlike the First Embodiment in which the wiring from the controller 4 to the input/output terminal SP1 or SP2 of the gate driver to which the start pulse signal $SP_G$ is first inputted is provided entirely on the print substrate 3 or 92, the group of gate drivers 112 is made up of gate drivers GD1', GD2', . . . , and GD'm, each of which is provided with a data circuit which directly outputs input data, and the start pulse signal $SP_G$ is transferred from the controller 4 to the input/output terminal SP1 or SP2 within the gate drivers as strictly as possible utilizing the serial connection of the gate drivers GD'1, GD'2, . . . , and GD'm. The gate drivers are mounted on TCPgd1', gd2', . . . , and gdm', which are arranged in accordance with the modified wiring this arrangement.

In the liquid crystal module 111 of FIG. 9, the start pulse signal $SP_G$ and the clock signal $CL_G$ are transferred in a direction from the gate driver GD1' to gate driver GDm' and in a direction from the gate driver GDm' to gate driver GD1', respectively, and the output terminal of the controller 4 for the start pulse signal $SP_G$ is connected to the input/output terminal DATA2 of the data circuit of the gate driver GDm', and the input/output terminal DATA1 of the data circuit of the gate driver GD1' is connected to the input/output terminal SP1 of the same gate driver GD1'. The gate drivers are also serially connected to each other with respect to the input/output terminals DATA1 and DATA2 of the data circuits. Note that, in order to be compatible with this connection, the print substrate 113 is provided with additional wiring (1) between the controller 4 and the input/output terminal DATA2 of the gate driver GDm', (2) between input/output terminal DATA2 of each gate driver and input/output terminal DATA1 of a gate driver on the following stage, and (3) between input/output terminal DATA1 of the gate driver GD1' and the input/output terminal SP1.

In the liquid crystal module 121 of FIG. 10, the start pulse signal $SP_G$ and the clock signal $CL_G$ are transferred in a direction from the gate driver GDm' to the gate driver GD1' and in a direction form the gate driver GD1' to the gate driver GDm', respectively, and the output terminal of the controller 4 for the start pulse signal $SP_G$ is connected to the input/output terminal DATA1 of the data circuit of the gate driver GD1', and the input/output terminal DATA2 of the data circuit of the gate driver GDm' is connected to the input/output terminal SP2 of the same gate driver GD1'. As shown in FIG. 9, the gate drivers are serially connected to each other also with respect to the input/output terminals DATA1 and DATA2 of the data circuits of the gate drivers. Note that, in order to be compatible with this connection, the print substrate 122 is provided with additional wiring (1) between the controller 4 and the input/output terminal DATA1 of the gate driver GD1', (2) between input/output terminal DATA2 of each gate driver and input/output terminal DATA1 of a gate driver on the following stage, and (3) between input/output terminal DATA2 of the gate driver GDm' and the input/output terminal SP2.

Figure 11:
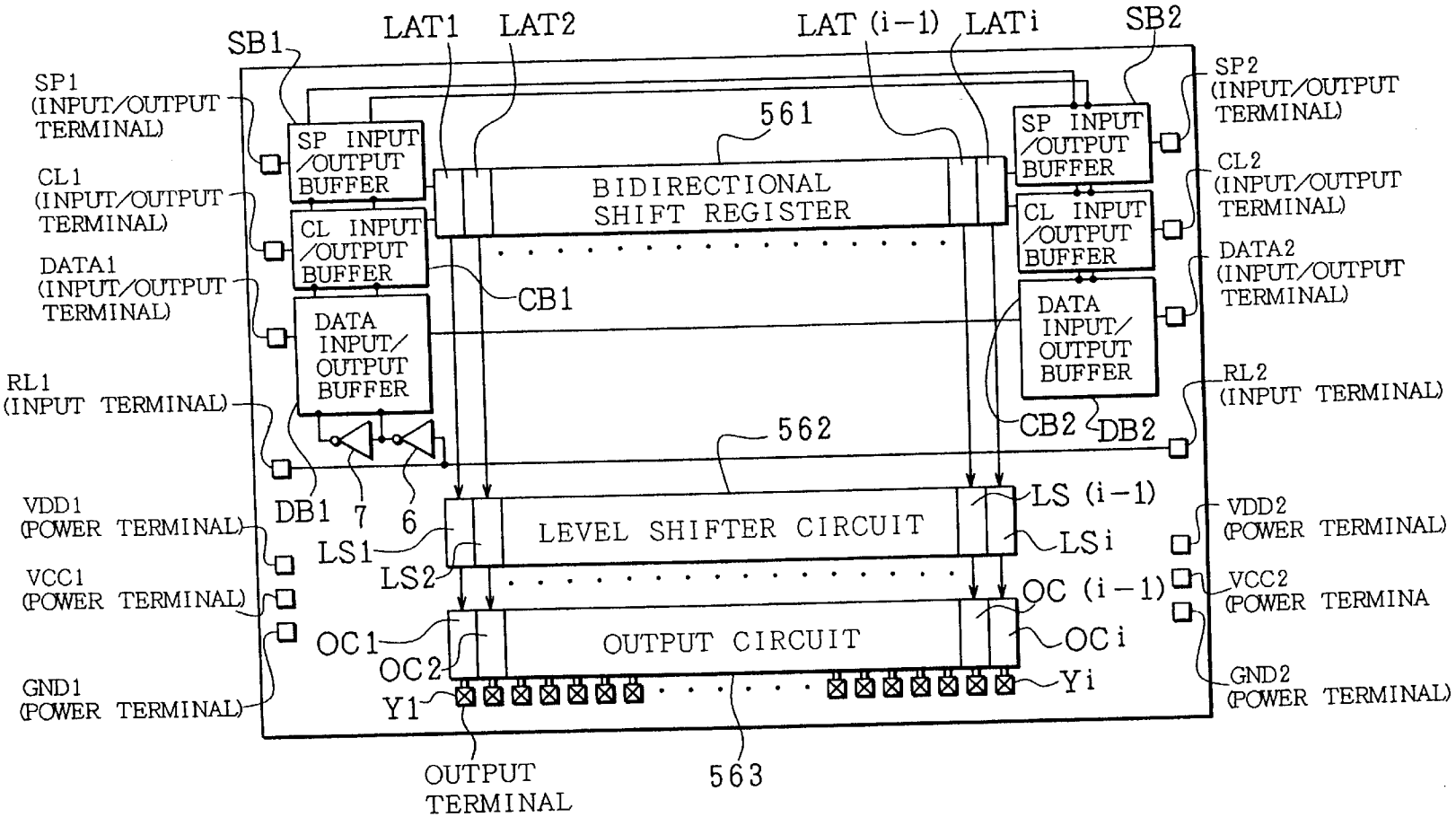
FIG. 11 is a block diagram showing a structure of a gate driver constituting the group of gate drivers of FIG. 9 and FIG. 10.

FIG. 11 is a circuit block diagram of one of the gate drivers of the group of gate drivers 112 as described above. The gate driver as shown in FIG. 11 has the same arrangement as that of the gate driver described in the First Embodiment except an additional data circuit which outputs data inputted to the input/output terminal DATA1 (or input/output terminal DATA2) directly from the input/output terminal DATA2 (or input/output terminal DATA1), and the input/output terminal DATA1 and input/output terminal DATA2 which are provided with DATA input/output buffer DB1 and DATA input/output buffer DB2, respectively. The DATA input/output buffers DB1 and DB2 receive the outputs of the inverters 6 and 7, and the input/output operations are switched in accordance with the logic level of the select signal $RL_G$.

Figure 12:
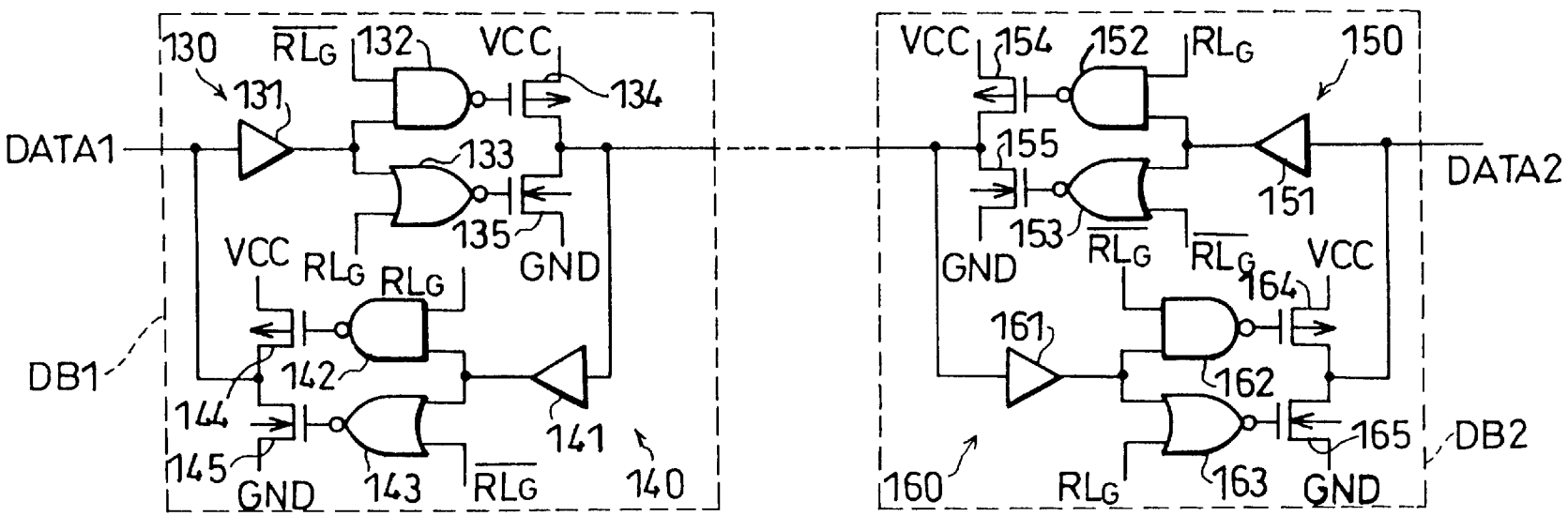
FIG. 12 is a circuit diagram showing a structure of DATA input/output buffers of the gate driver of FIG. 11.

FIG. 12 shows specific circuit structures of the DATA input/output buffers DB1 and DB2. The DATA input/output buffer DB1 is composed of (a) an input buffer circuit 130 which includes a buffer 131, NAND gate 132, NOR gate 133, p channel MOSFET 134, and n channel MOSFET 135 and (b) an output buffer circuit 140 which includes a buffer 141, NAND gate 142, NOR gate 143, p channel MOSFET 144, and n channel MOSFET 145.

In the input buffer circuit 130, the input terminal of the buffer 131 is connected to the input/output terminal DATA1, and the output terminal thereof is connected to one of the input terminals of the NAND gate 132 and to one of the input terminals of the NOR gate 133. The other input terminal of the NAND gate 132 is connected to the output terminal of the inverter 6 and the select signal/$RL_G$ is inputted, and the other input terminal of the NOR gate 133 is connected to the output terminal of the inverter 7 and the select signal $RL_G$ is inputted. The output terminal of the NAND gate 132 is connected to the gate of the p channel MOSFET 134, and the output terminal of the NOR gate 133 is connected to the gate of the n channel MOSFET 135.

The drain of the p channel MOSFET 134 is connected to the power terminal VCC1 or VCC2 and a "High" level potential VCC is maintained, and the source of the n channel MOSFET 135 is connected to the power terminal GND1 or GND2 and a "low" level potential GND is maintained. Further, the source of the p channel MOSFET 134 is connected to the drain of the n channel MOSFET 135 and the junction is connected to a latch circuit LAT1 on the first stage of the bidirectional shift register 561.

In the output buffer circuit 140, the input terminal of the buffer 141 is connected to the latch circuit LAT1 on the first stage of the bidirectional shift register 561, and the output terminal thereof is connected to one of the input terminals of the NAND gate 142 and to one of the input terminals of the NOR gate 143. The other input terminal of the NAND gate 142 is connected to the output terminal of the inverter 7 and the select signal $RL_G$ is inputted, and the other input terminal of the NOR gate 143 is connected to the output terminal of the inverter 6 and the select signal/$RL_G$ is inputted. The output terminal of the NAND gate 142 is connected to the gate of the p channel MOSFET 144, and the output terminal of the NOR gate 143 is connected to the gate of the n channel MOSFET 145.

Further, the drain of the p channel MOSFET 144 is connected to the power terminal VCC1 or VCC2 and a "High" level potential VCC is maintained, and the source of the n channel MOSFET 145 is connected to the power terminal GND1 or GND2 and a "Low" level potential GND is maintained. Further, the source of the p channel MOSFET 144 is connected to the drain of the n channel MOSFET 145 and the junction is connected to the input/output terminal DATA1.

The DATA input/output buffer DB2 is composed of (a) an input buffer circuit 150 which includes a buffer 151, NAND gate 152, NOR gate 153, p channel MOSFET 154, and n channel MOSFET 155 and (b) an output buffer circuit 160 which includes a buffer 161, NAND gate 162, NOR gate 163, p channel MOSFET 164, and n channel MOSFET 165.

In the input buffer circuit 150, the input terminal of the buffer 151 is connected to the input/output terminal DATA2, and the output terminal thereof is connected to one of the input terminals of the NAND gate 152 and to one of the input terminals of the NOR gate 153. The other input terminal of the NAND gate 152 is connected to the output terminal of the inverter 7 and the select signal $RL_G$ is inputted, and the other input terminal of the NOR gate 153 is connected to the output terminal of the inverter 6 and the select signal/$RL_G$ is inputted. The output terminal of the NAND gate 152 is connected to the gate of the p channel MOSFET 154, and the output terminal of the NOR gate 153 is connected to the gate of the n channel MOSFET 155.

The drain of the p channel MOSFET 154 is connected to the power terminal VCC1 or VCC2 and a "High" level potential VCC is maintained, and the source of the n channel MOSFET 155 is connected to the power terminal GND1 or GND2 and a "low" level potential GND is maintained. Further, the source of the p channel MOSFET 154 is connected to the drain of the n channel MOSFET 155 and the junction is connected to a latch circuit LATi on the last stage of the bidirectional shift register 561.

In the output buffer circuit 160, the input terminal of the buffer 161 is connected to the latch circuit LATi on the last stage of the bidirectional shift register 561, and the output terminal thereof is connected to one of the input terminals of the NAND gate 162 and to one of the input terminals of the NOR gate 163. The other input terminal of the NAND gate 162 is connected to the output terminal of the inverter 6 and the select signal/$RL_G$ is inputted, and the other input terminal of the NOR gate 163 is connected to the output terminal of the inverter 7 and the select signal $RL_G$ is inputted. The output terminal of the NAND gate 162 is connected to the gate of the p channel MOSFET 164, and the output terminal of the NOR gate 163 is connected to the gate of the n channel MOSFET 165.

Further, the drain of the p channel MOSFET 164 is connected to the power terminal VCC1 or VCC2 and a "High" level potential VCC is maintained, and the source of the n channel MOSFET 165 is connected to the power terminal GND1 or GND2 and a "Low" level potential GND is maintained. Further, the source of the p channel MOSFET 164 is connected to the drain of the n channel MOSFET 165 and the junction is connected to the input/output terminal DATA2.

In the DATA input/output buffers DB1 and DB2 having the described structures, when the select signal $RL_G$ is at "Low" level, in the DATA input/output buffer DB1, one of the p channel MOSFET 134 and n channel MOSFET 135 of the output buffer circuit 130 will be in a high impedance state while the other is in an ON state, and both the p channel MOSFET 144 and n channel MOSFET 145 of the output buffer circuit 140 will be in a high impedance state, and as a result the DATA input/output buffer DB1 operates as the input buffer. Here, in the same manner, the DATA input/output buffer DB2 operates as the output buffer. When the select signal $RL_G$ is at "High" level, the reverse operation will occur and the DATA input/output buffer DB1 operates as the output buffer and the DATA input/output buffer DB2 operates as the input buffer.

Table 2 shows the input/output mode of the DATA input/output buffers DB1 and DB2 with respect to the logic level of the select signal $RL_G$, together with the input/output mode of the SP input/output buffers SB1 and SB2 and CL input/output buffers CB1 and CB2.

TABLE 2

| | SELECT SIGNAL $RL_G$ | |
|---|---|---|
| INPUT/OUTPUT BUFFER | "LOW" | "HIGH" |
| SP INPUT/OUTPUT BUFFER SB1 | OUTPUT BUFFER | INPUT BUFFER |
| SP INPUT/OUTPUT BUFFER SB2 | INPUT BUFFER | OUTPUT BUFFER |
| CL INPUT/OUTPUT BUFFER CB1 | INPUT BUFFER | OUTPUT BUFFER |
| CL INPUT/OUTPUT BUFFER CB2 | OUTPUT BUFFER | INPUT BUFFER |
| DATA INPUT/OUTPUT BUFFER DB1 | INPUT BUFFER | OUTPUT BUFFER |
| DATA INPUT/OUTPUT BUFFER DB2 | OUTPUT BUFFER | INPUT BUFFER |

In accordance with Table 2, the select signal $RL_G$ is set at "High" level in the case of the liquid crystal module 111 of FIG. 9, and by operating the DATA input/output buffers DB1 and DB2 as output buffer and input buffer, respectively, the start pulse signal $SP_G$ outputted from the controller 4 is transferred in a direction from the gate driver GDm' to the gate driver GD1' and is then inputted to the input/output terminal SP1 of the gate driver GD1'.

In the case of the liquid crystal module 121 of FIG. 10, the select signal $RL_G$ is set at "Low" level, and by operating the DATA input/output buffers DB1 and DB2 as input buffer and output buffer, respectively, the start pulse signal $SP_G$ outputted from the controller 4 is transferred in a direction from the gate driver GD1' to the gate driver GDm' and is then inputted to the input/output terminal SP2 of the gate driver GDm'.

In either case of the liquid crystal module 111 and liquid crystal module 121, the start pulse signal $SP_G$ inputted as data to the data circuit is transferred in the same direction as that of the clock signal $CL_G$ until the start pulse signal $SP_G$ reaches the input/output terminal SP1 or SP2.

In this manner, by transferring the start pulse signal $SP_G$ through the gate drivers which are serially connected to each other as strictly as possible using the wiring of the data circuits instead of external wiring provided on the print substrate 3 as described in the First Embodiment, the area of print substrate can be reduced by way of reducing the width by the amount of wiring which was provided on the print substrate, and the waveform rounding of the start pulse signal $SP_G$ before it is inputted to the input/output terminal SP1 or SP2 can be reduced and an adverse effect of external noise occurs less often.

Then, as with the First Embodiment, the start pulse signal $SP_G$ and clock signal $CL_G$ are transferred in the opposite directions through the group of gate drivers 112. Thus, the start pulse signal $SP_G$ can be latched and outputted at a correct timing and the gate pulse generated based on this output is outputted to the gate bus line at a correct timing from the output circuit 563, and unlike the conventional example, there occurs no malfunction of the liquid crystal module.

Figure 13:
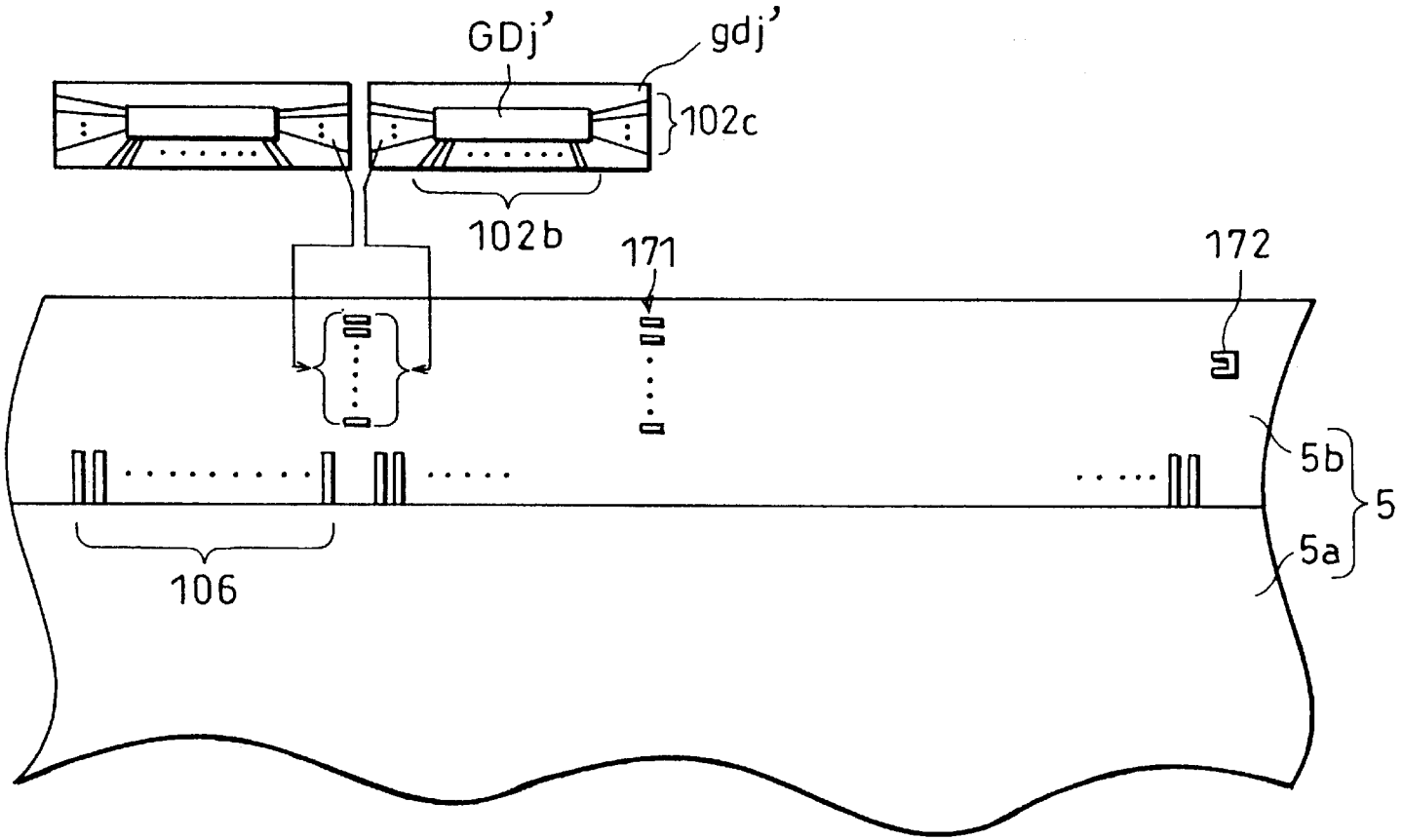
FIG. 13 is a plan view explaining how the group of gate drivers of FIG. 9 and FIG. 10 are mounted on the liquid crystal module.

With the use of the group of gate drivers 112 of the preset embodiment, the mount as shown in FIG. 13 is possible. In FIG. 13, the lower glass 5*b* used for the liquid crystal panel 5 is larger than the upper glass 5*a*, and there are provided wiring (ITO wiring) which connects to one another TCPgdj' (j=1, 2, . . . , m) bearing gate drivers GDj' which are mounted on an exposed portion of the lower glass 5*b*, and wiring (ITO wiring) which connects the TCPgdj' to the liquid crystal panel 5. Connection wiring 171 is provided for the connection between outer lead terminals of adjacent TCPs, and connection wiring 172 is provided for the connection between the outer lead terminal which extends from the input/output terminal DATA1 of the gate driver GD1' and the outer lead which extends from the input/output terminal SP1, or alternatively between the outer lead terminal which extends from the input/output terminal DATA2 of the gate driver GDm' and the outer lead terminal which extends from the input/output terminal SP2.

In this case, heat-bonding by ACF can be employed not only for connecting the output side outer lead terminals 102*b* of the TCPgdj' to the connection wiring 106 on the liquid crystal panel 5 but also for connecting the input side outer lead terminals 102*c* of the TCPgdj' to the connection wiring 171 and 172 on the liquid crystal panel 5, thus reducing costs.

With this arrangement, the print substrates 113 and 122 can be omitted, thereby reducing the size of a mount region of the group of gate drivers 112 to meet the demand of smaller liquid crystal modules.

Note that, in the liquid crystal module 111 as shown in FIG. 9, the input side outer lead terminal of the TCPgd1', which extends from the input/output terminal DATA1 of the gate driver GD1', and the input side outer lead terminal of the TCPgd1', which extends from the input/output terminal SP1 of the gate driver GD1', are connected to each other on the print substrate 113 having a step-difference with the TCPgd1', i.e., the connection is made by the wiring on the flexible substrate. Similarly, in the liquid crystal module 121 as shown in FIG. 10, the input side outer lead terminal of the TCPgdm', which extends from the input/output terminal DATA2 of the gate driver GDm', and the input side outer lead terminal of the TCPgdm', which extends from the input/output terminal SP2 of the gate driver GDm', are connected to each other on the print substrate (flexible substrate) 122 having a step-difference with the TCPgdm'. Further, in the mount as shown in FIG. 13, the input side outer lead terminals are connected to each other by the connection wiring 172 on the lower glass 5*b* as a substrate having a step-difference with the TCPgdj'.

Figure 14:
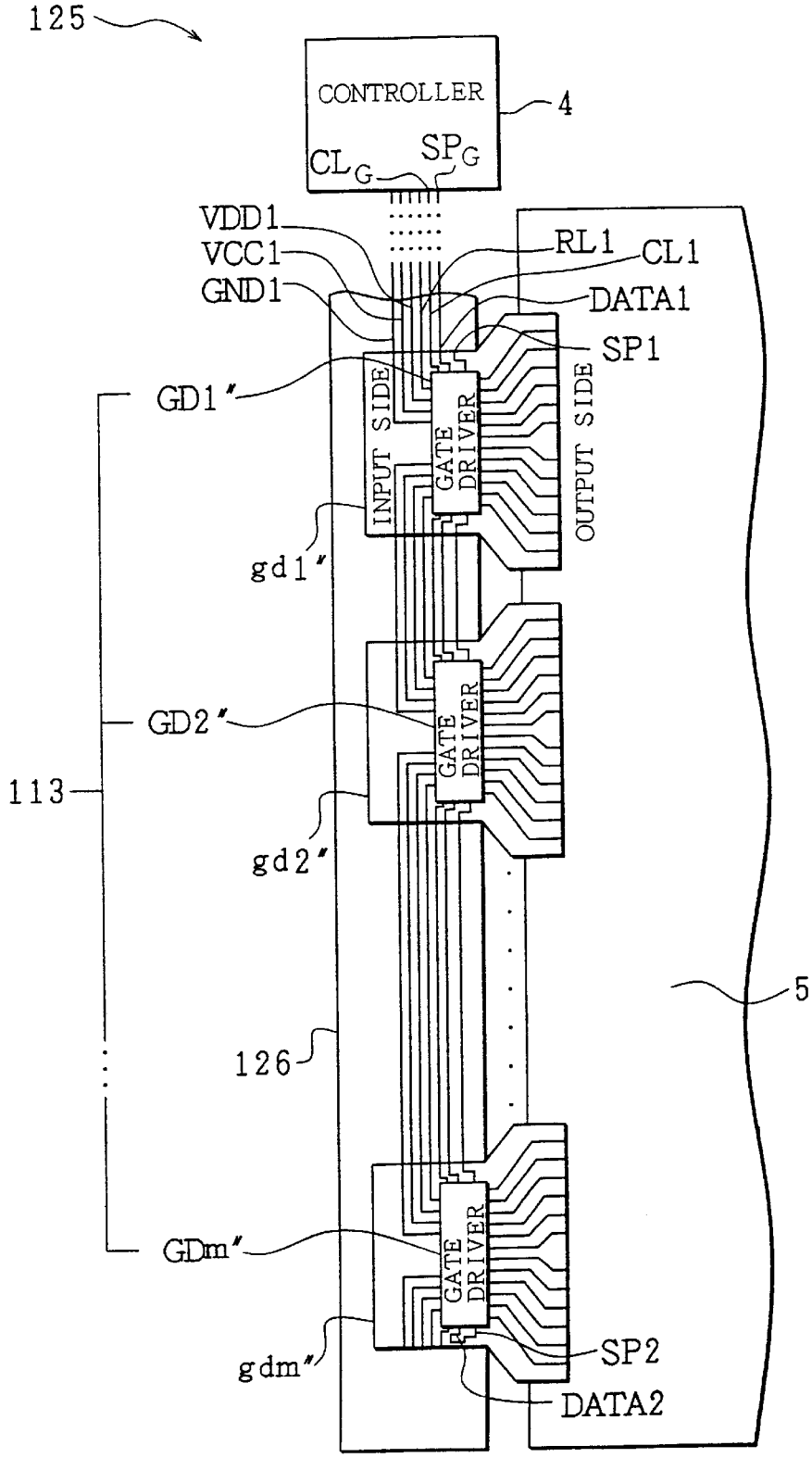
FIG. 14 is a plan view showing a modification example of the structure of the liquid crystal module of FIG. 10.
Figure 15:
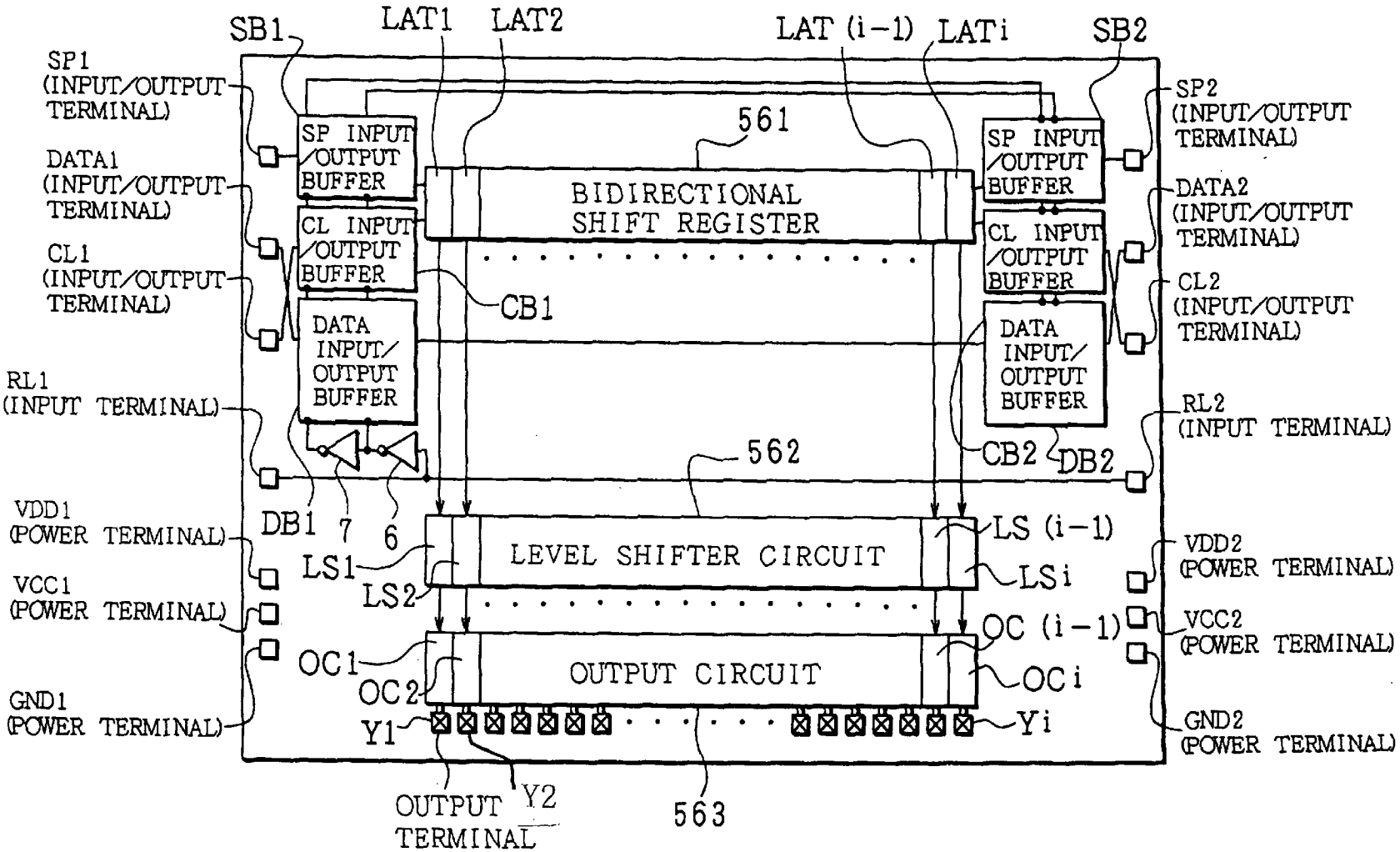
FIG. 15 is a block diagram showing a structure of a gate driver constituting the group of gate drivers used in the liquid crystal module of FIG. 14.

In the event where the connection of input side outer lead terminals on a step-difference poses the problem of broken wire and connection failure as caused by the step-difference, a liquid crystal module 125 may be arranged using a group of gate drivers 113 as shown in FIG. 14. The group of gate drivers 113 in the liquid crystal module 125 of FIG. 14 is composed of gate drivers GDj" (j=1, 2, . . . , m), in each of which the input/output terminal SP1 and the input/output terminal DATA1 are placed adjacent to each other, and the input/output terminal SP2 and the input/output terminal DATA2 are placed adjacent to each other, as shown in FIG. 15. The other arrangement of the gate driver GDj" is the same as that of FIG. 11.

The gate drivers GDj" are serially connected to each other by the input side outer lead terminals while being mounted on the TCPgdj". The TCPgdj" are connected to each other by the wiring on the print substrate 126. In the TCPgdm" of the TCPgdj" mounting the gate driver GDj", the input side outer lead terminal which extends from the input/output terminal DATA2 and the input side outer lead terminal which extends from the input/output terminal SP2 are connected to be shorted on the TCPgdm".

The controller 4 is provided on the side of the gate driver GD1", and the start pulse signal $SP_G$ outputted from the controller 4 is inputted to the input/output terminal DATA1 of the gate driver GD1" and is transferred in a direction toward the gate driver GDm", and in the gate driver GDm', the start pulse signal $SP_G$ is inputted to the input/output terminal SP2 via the input/output terminal DATA2 and the transfer direction is reversed. Also, each gate driver GDj" is connected to the liquid crystal panel 5 by the output side outer lead terminal of the TCPgdj". Note that, the controller 4 may be provided on the side of the gate driver GDm", and the input side outer lead terminals may be shorted on the TCPgd1".

Figure 16:
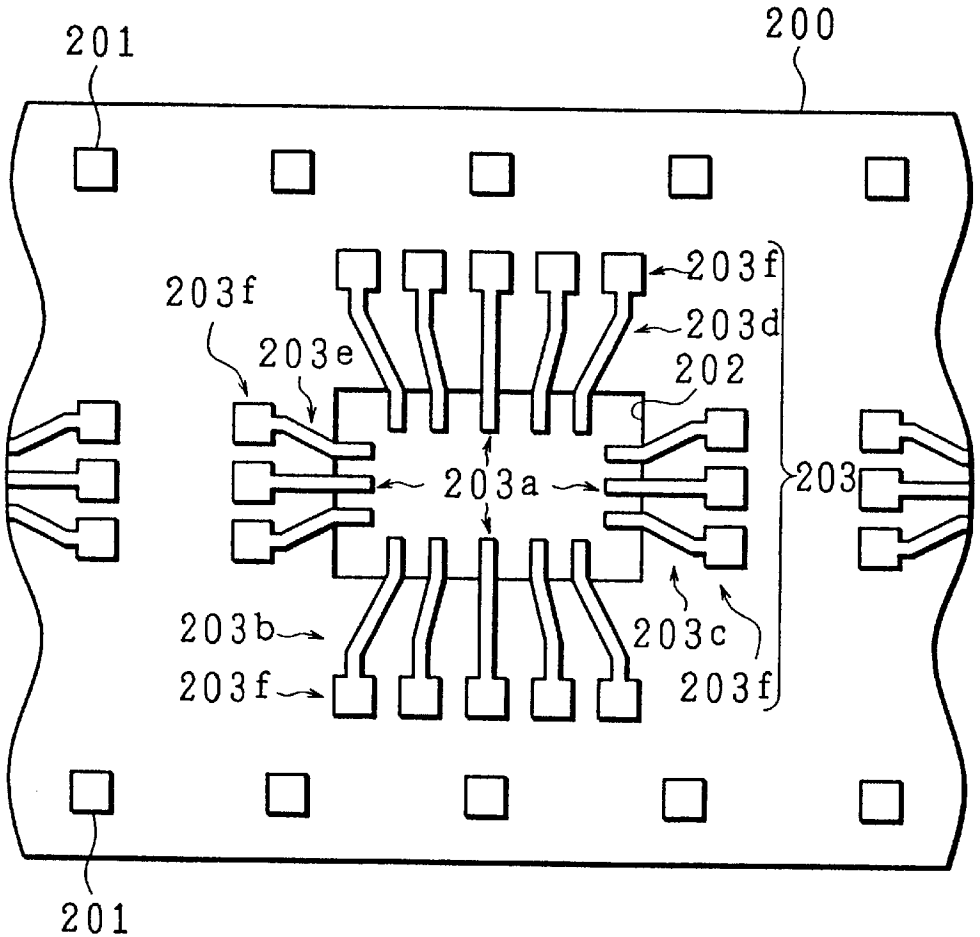
FIG. 16 is a plan view showing a general structure of a tape carrier package.
Figure 17:
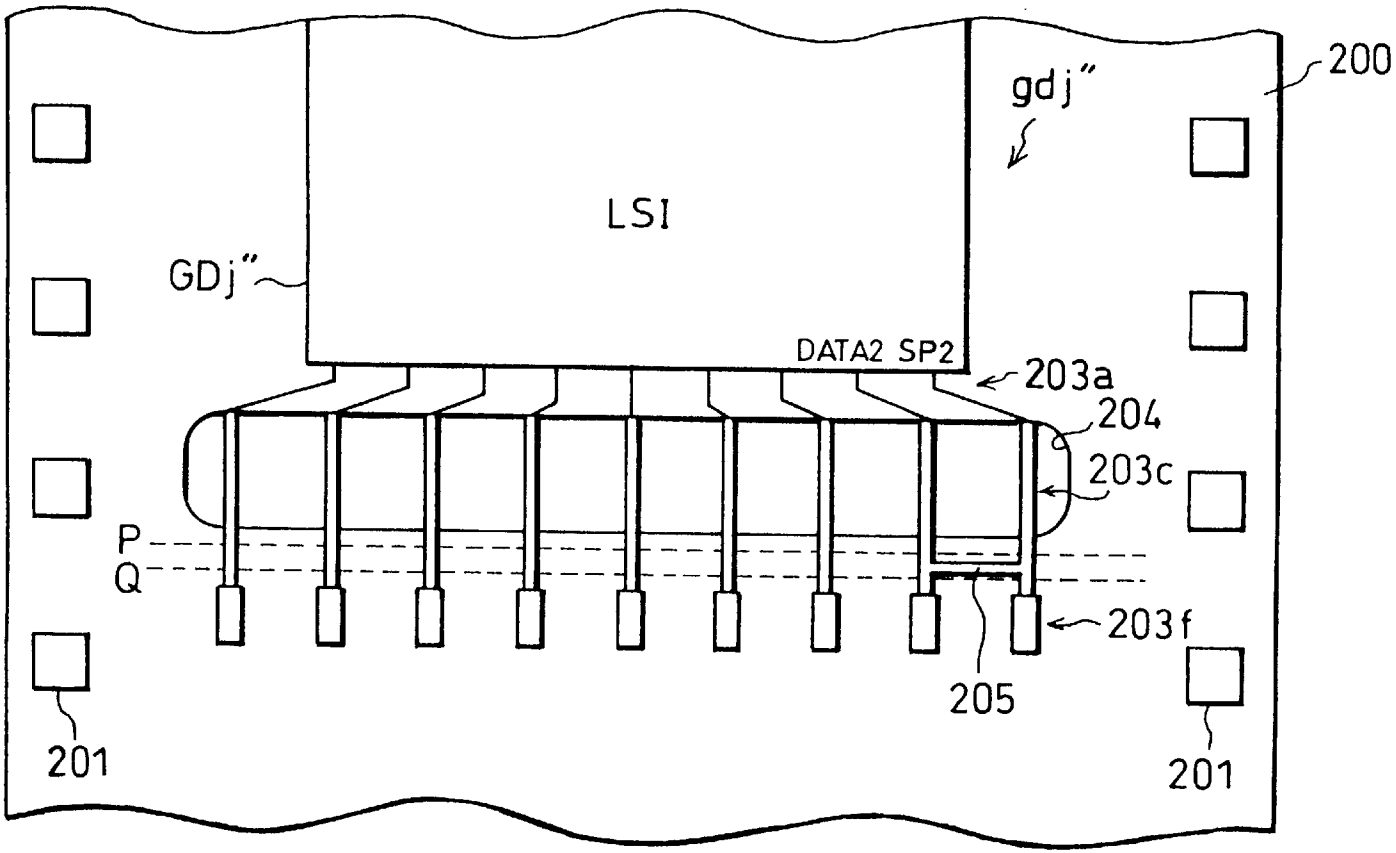
FIG. 17 is an explanatory drawing explaining a manufacturing method of a tape carrier package used in the liquid crystal module of FIG. 14.
Figure 18:
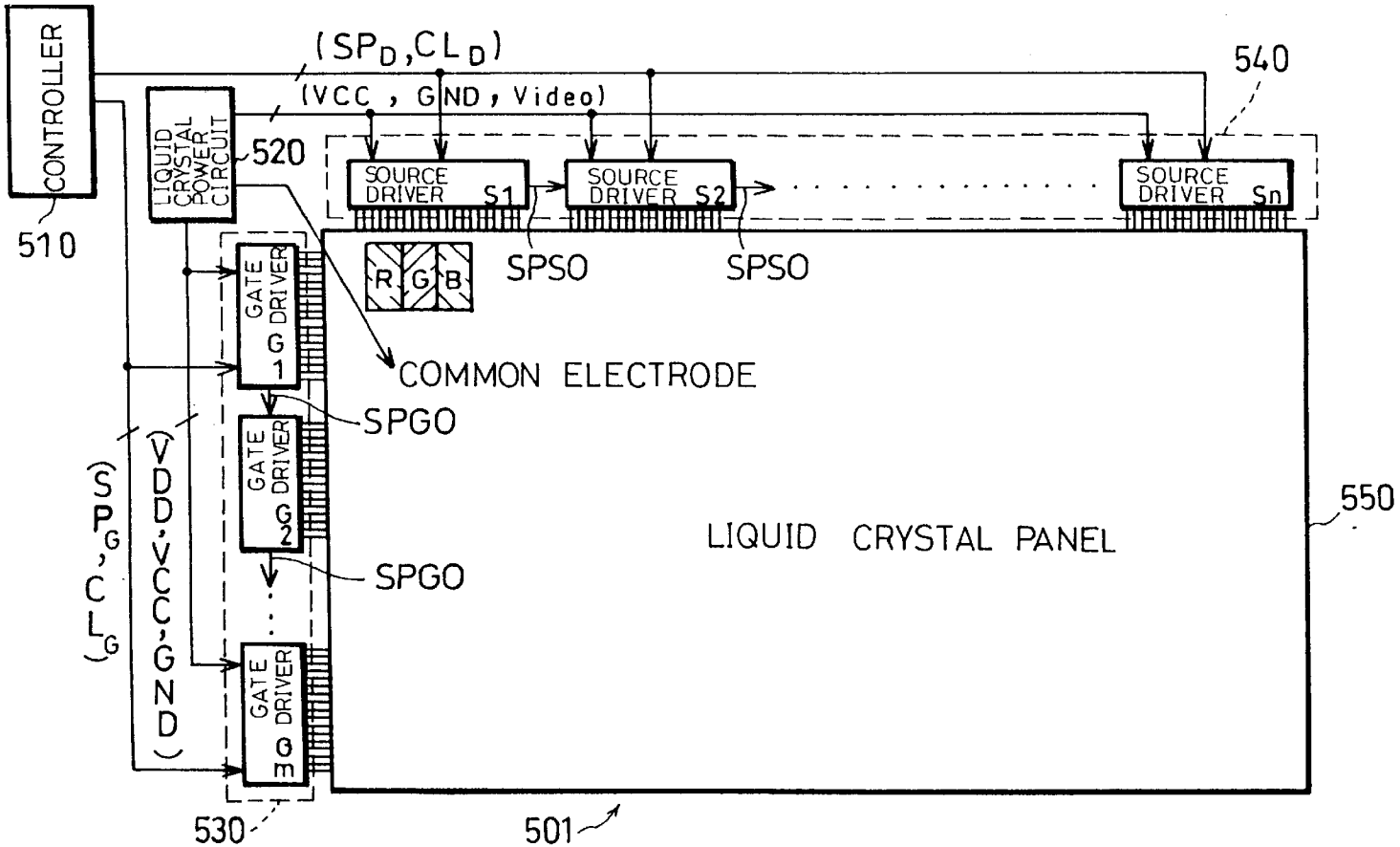
FIG. 18 is a block diagram showing a structure of a conventional liquid crystal module.
Figure 19:
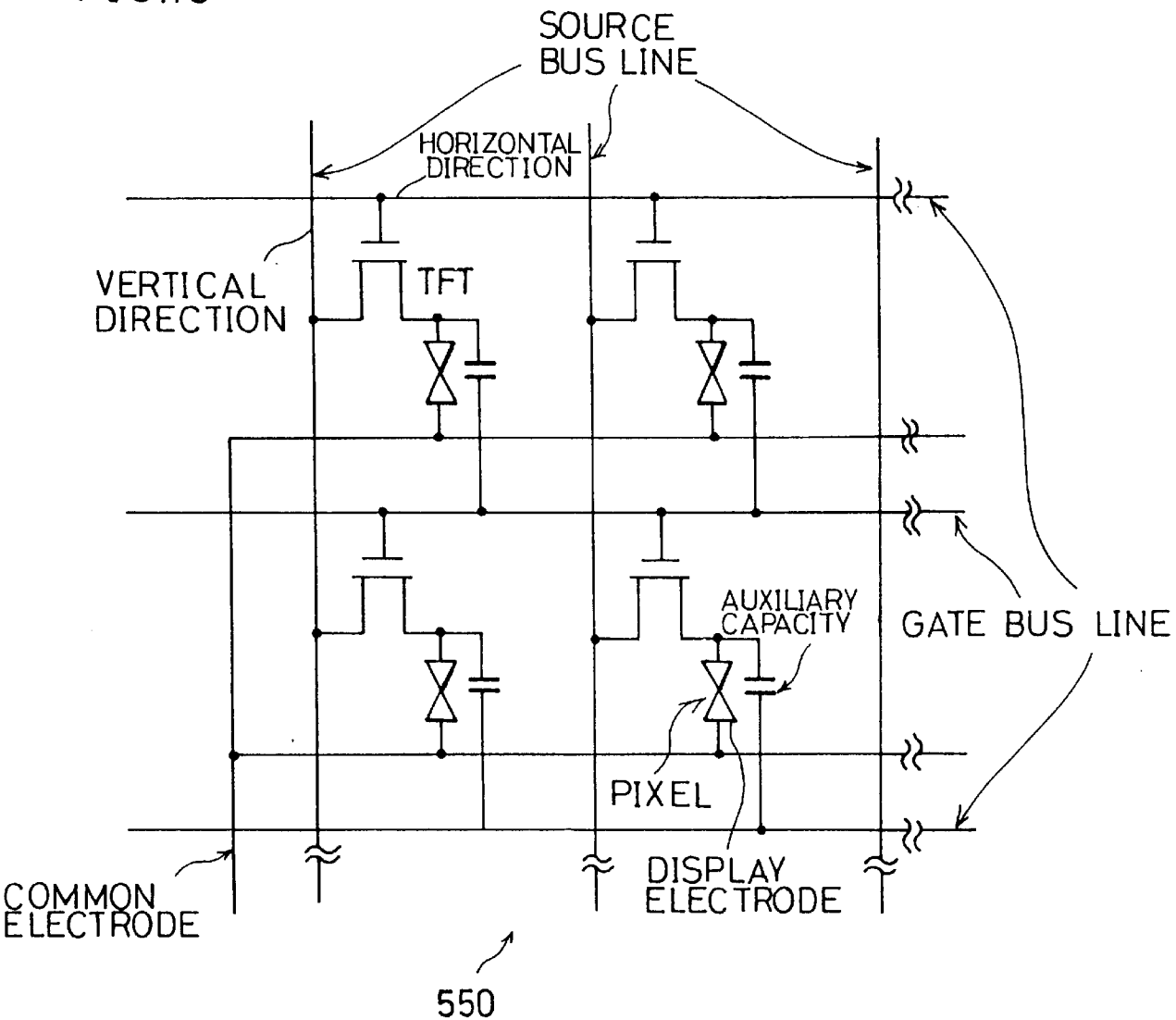
FIG. 19 is a circuit diagram showing an equivalent circuit of a liquid crystal panel of the liquid crystal module of FIG. 18.
Figure 20:
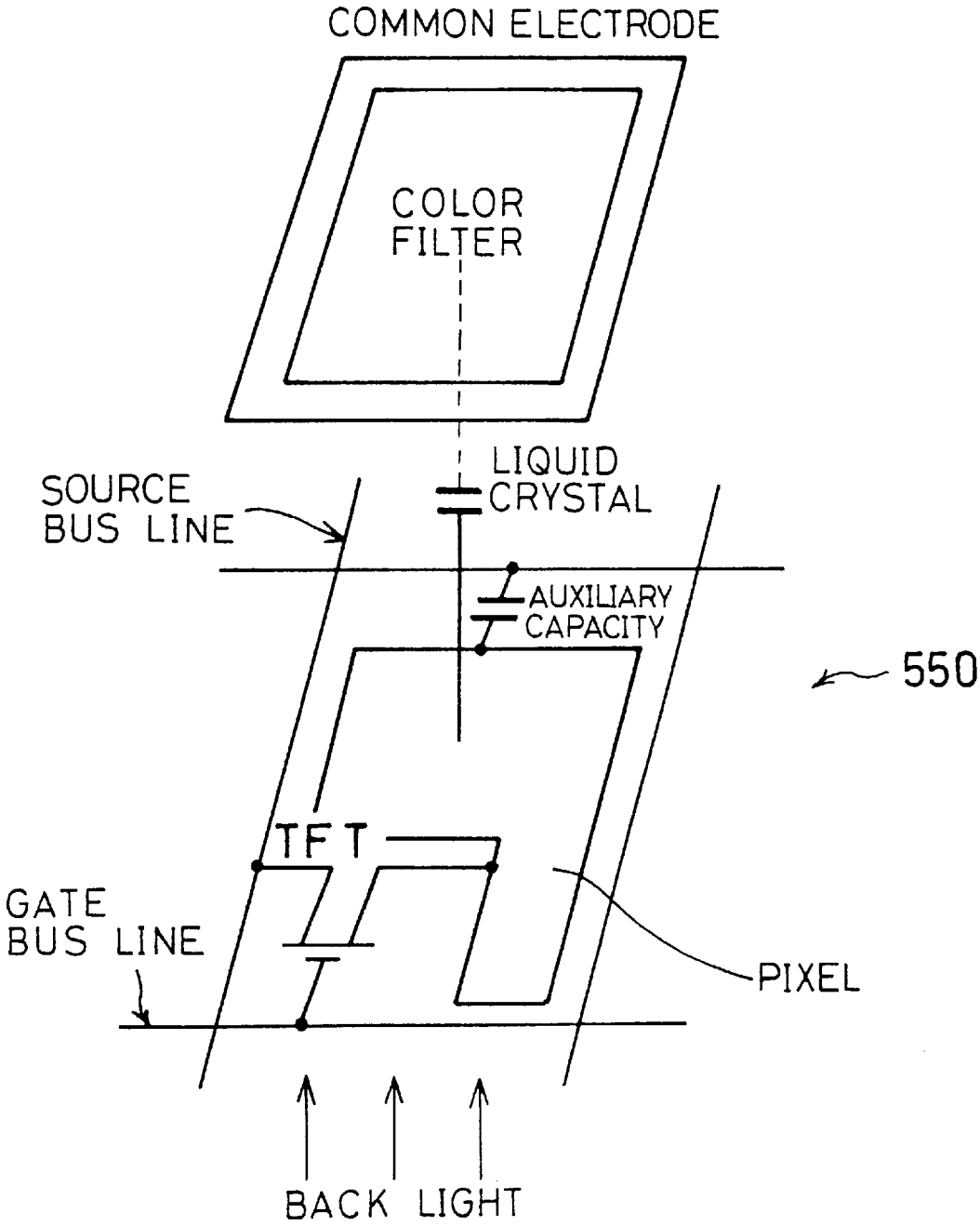
FIG. 20 is an explanatory drawing explaining an arrangement of pixels of the liquid crystal panel of FIG. 19.
Figure 21:
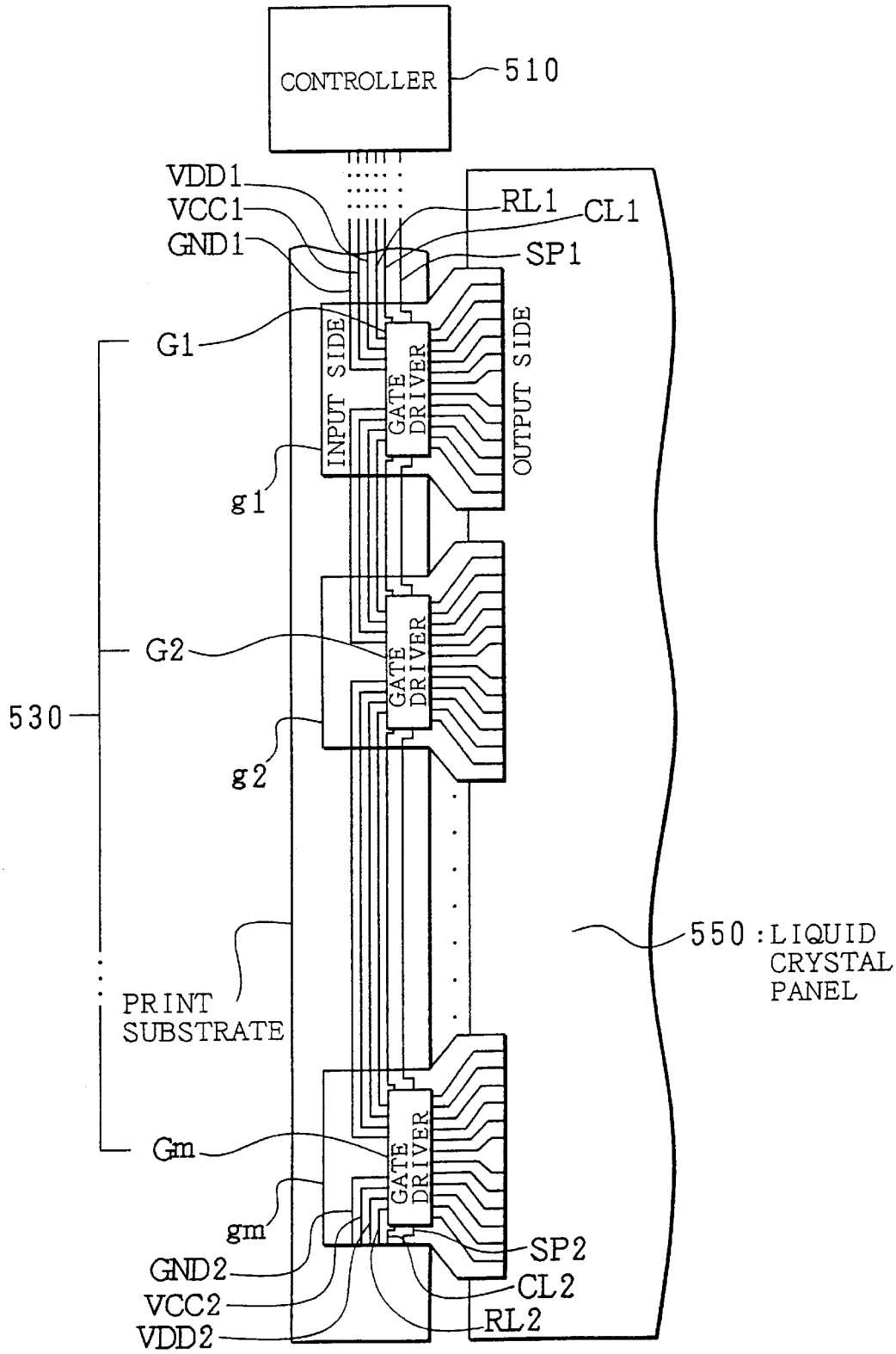
FIG. 21 is a plan view showing a structure in the vicinity of a group of gate drivers used in the liquid crystal module of FIG. 18.
Figure 22:
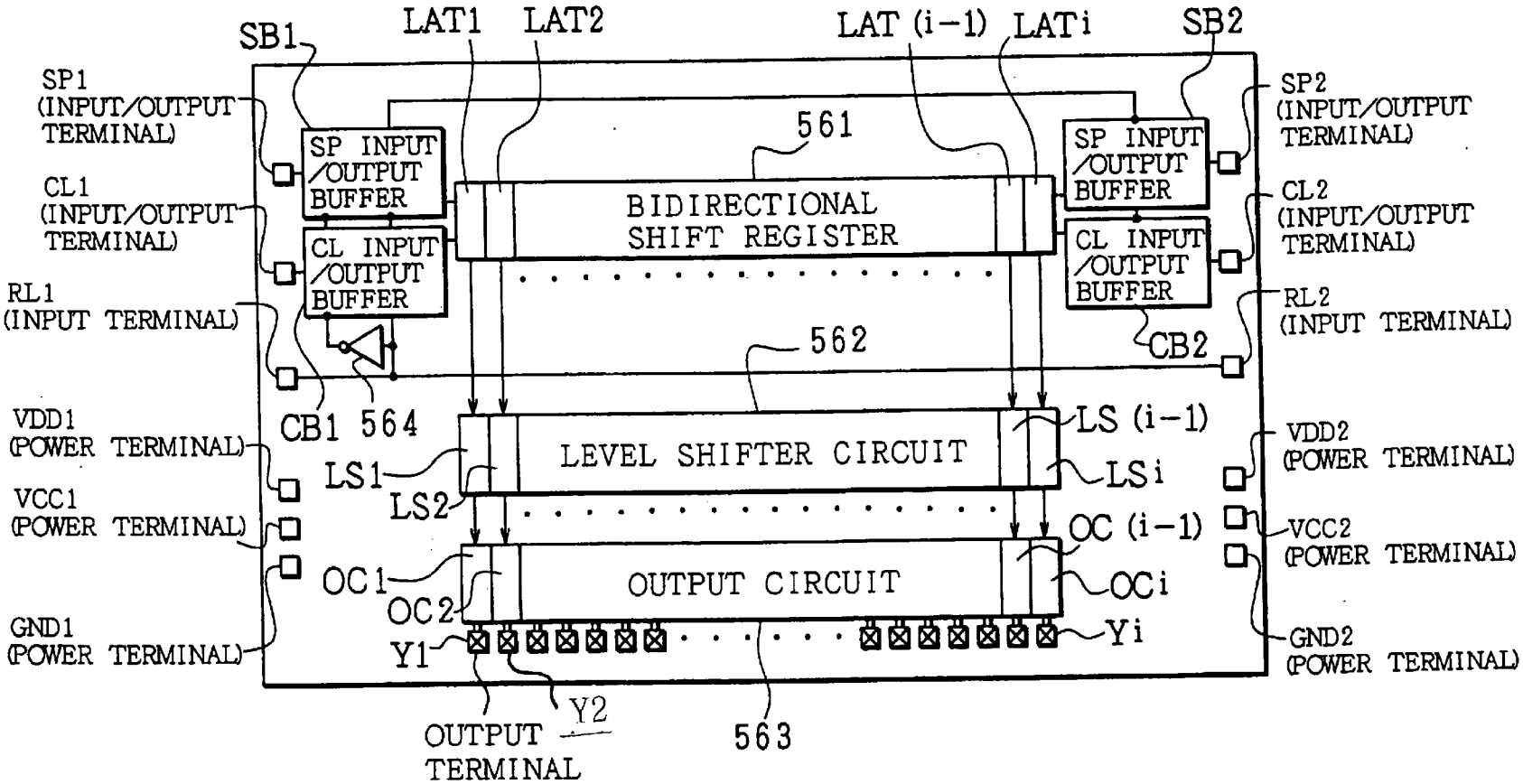
FIG. 22 is a block diagram showing a structure of a gate driver constituting the group of gate drivers of FIG. 21.
Figure 23:
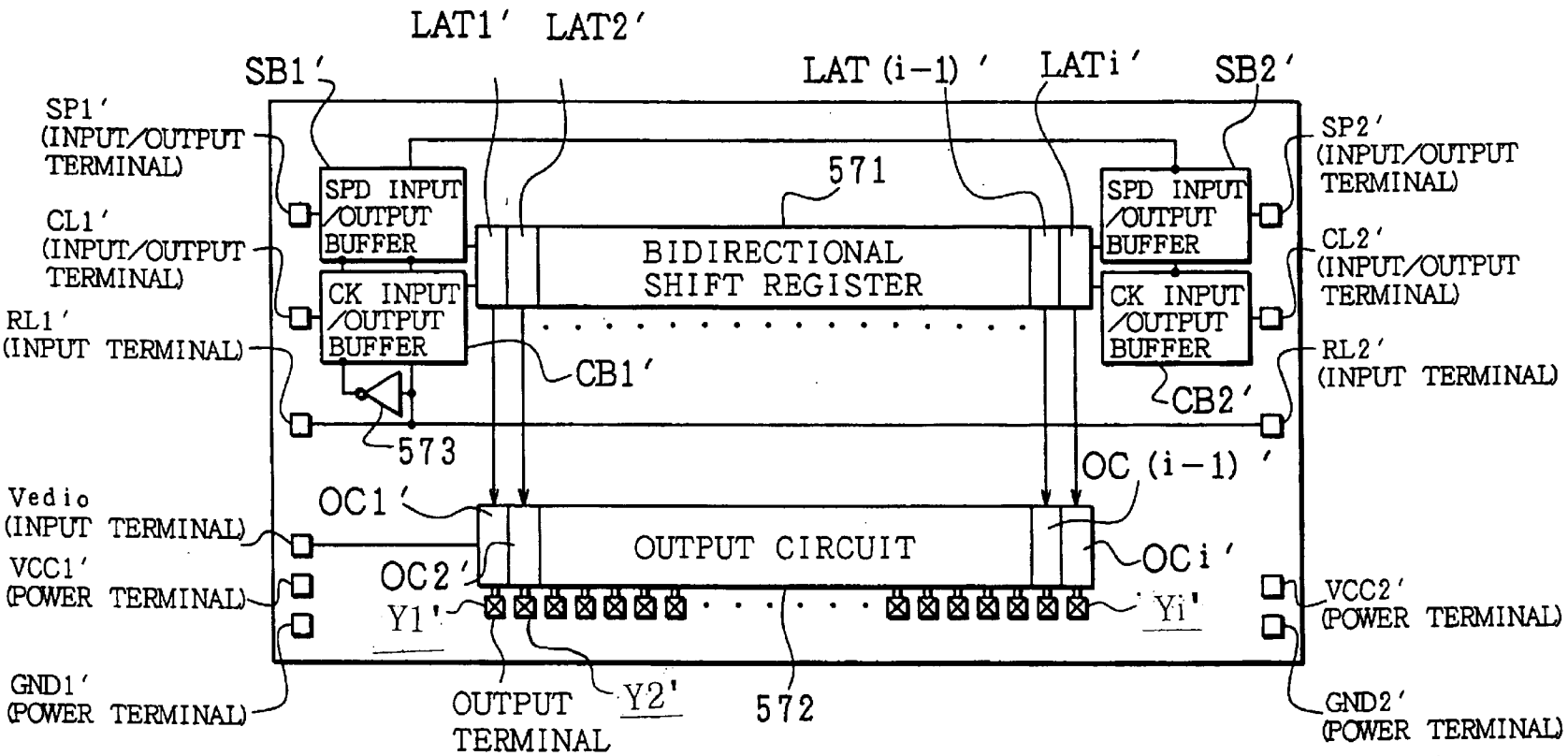
FIG. 23 is a block diagram showing a structure of a source driver constituting a group of source drivers used in the liquid crystal module of FIG. 18.
Figure 24:
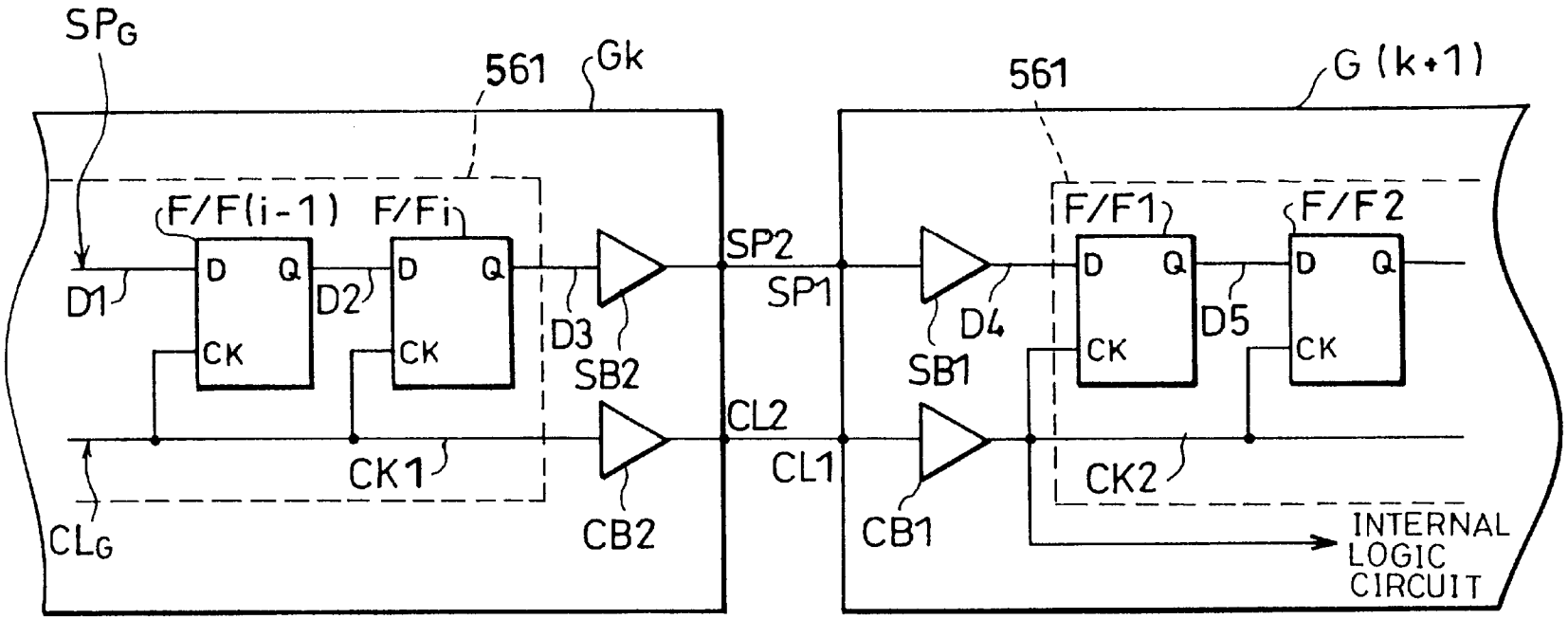
FIG. 24 is an explanatory drawing explaining how the start pulse signal and the clock signal are transferred in the group of gate drivers of FIG. 21.
Figure 25:
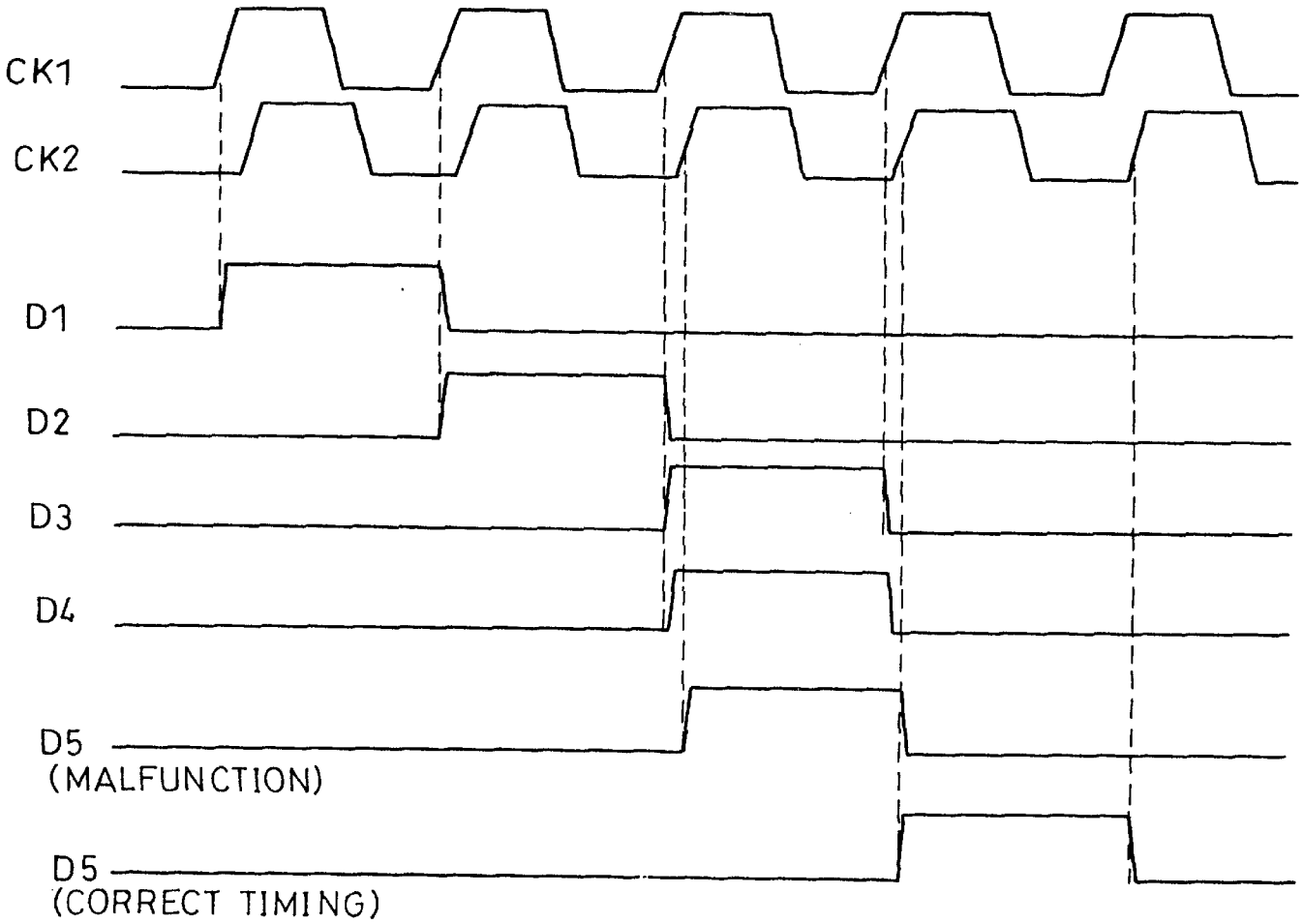
FIG. 25 is a timing chart showing a transfer process of the start pulse signal and the clock signal in the explanatory drawing of FIG. 24.

The following will describe an arrangement and manufacturing method of the TCPgdj" referring to FIG. 16 and FIG. 17. FIG. 16 is a concept plan view of a common TCP. The TCP is manufactured with the base material of an insulating film 200, and on the sides orthogonal to the transfer direction of the insulating film 200 are formed beforehand sprocket holes 201 to be used for transfer and positioning in transfer. In manufacturing the TCP, first, a semiconductor chip opening section 202 for mounting a semiconductor chip is formed on the inner side of the sprocket holes 201. In the present embodiment, the semiconductor chip corresponds to the gate driver. Then, a metal foil such as a copper foil is laminated on the insulating film 200, and patterning of predetermined wiring 203 is carried out altogether by a process such as etching.

Portions of the wiring 203 which extend into the semiconductor chip opening section 202 are inner lead terminals 203*a*, and the portions which extend in the opposite direction from the inner lead terminals 203*a* are outer lead terminals 203*b* to 203*e* to be used for connection with external circuits. In the present embodiment, for example, the outer lead terminals 203*c* and 203*e* correspond to the input side outer lead terminals and the outer lead terminal 203*b* corresponds to the output side outer lead terminal.

The portions of the outer lead terminals 203*b* to 203*e* further toward outside are electric selection pads 203*f* to be used for testing the operation of the TCP after the semiconductor chip is connected to the inner lead terminals 203*f* by the semiconductor opening section 202. Generally, the region of the insulating film 200 on which the electric selection pads 203*f* is provided is a region which is not required for operation and is cut out along the border line of the user area (not shown) when separating the TCP one by one after the semiconductor chip is mounted on the insulating film 200 and after the operation test of the chip is finished. Upon completion of this cutting process, the manufacturing of the TCP is finished.

The following will describe the arrangement and manufacturing method of the TCPgdj" of FIG. 14 in more detail referring to FIG. 17 based on the above explanation. In FIG. 17, an opening section 104 is formed beforehand on a portion of a region of the insulating film 200 where the outer lead terminals 203*c* corresponding to the input side outer lead terminals are to be formed. Note that, though not shown in FIG. 17, the opening section 204 is also formed on the side of the outer lead terminals 203*e*. When forming the wiring 203 in the described manner, a short-circuit portion 205 is formed so that the outer lead terminals 203*c* which extend from the input/output terminal DATA2 and input/output terminal SP2 of the gate driver GDj", respectively, which is provided as the LSI chip are shorted before corresponding electric selection pads 203*f*.

Then, the gate driver GDj" is mounted on the insulating film 200 and the operation test is performed. After the operation test, when the gate driver GDj" is to be used as the gate driver GDm" as shown in FIG. 14, the TCPgdj", i.e., the insulating film 200 of the TCPgdm" is cut out along the cutting line Q separating the short-circuit portion 205 and the electric selection pads 203*f*. On the other hand, when the gate driver GDj" is to be used as the gate driver GDj" (j=1, 2, . . . , m−1), the insulating film 200 of the TCPgdj" is cut out along the cutting line P between the short-circuit portion 205 and the opening section 204 so as not to leave out the short-circuit portion 205.

In this manner, the wiring is formed by shorting beforehand predetermined two input side outer lead terminals with respect to all the TCPgdj", which allows the same manufacturing steps to be used for all TCPgdj" up until the cutting process of the insulating film 200, thus separating the TCPgdj" of the last stage and the other TCPgdj" at the cutting process. As a result, the group of gate drivers 113 of FIG. 14 can be manufactured efficiently. Further, even when the arrangement of the input/output terminals of the gate driver GDj" is changed, corresponding TCPgdj" can be manufactured only by changing the short-circuit portion 205, thus improving the degree of freedom in the serial connection.

As described, with the arrangement of the liquid crystal module 125 of FIG. 14, by forming the continuous wiring from the input side outer lead terminal DATA2 to the input/output terminal SP2 when patterning the wiring on the TCPgdj", the short-circuit portion 205 of the input side outer lead terminals can be formed. Thus, it is not required to connect by substrate wiring the input side outer lead terminal, which is connected to the input/output terminal DATA2, and the input side outer lead terminal, which is connected to the input/output terminal SP2, over a step-difference. As a result, the broken wire and connection failure can be prevented and the reliability of electrical connections can be improved, which in turn improves the productivity in mass production. Further, the described arrangement and manufacturing method can also be applied to the mount as shown in FIG. 13, and in such a case, the connection wiring 172 can be omitted.

As described, the display driving device of the present embodiment, in addition to the arrangement of the First Embodiment, is arranged such that the plurality of driving semiconductor elements further and each includes a data circuit for directly outputting input data, and a data input terminal and a data output terminal of the data circuit are serially connected to each other so that the data is transferred in a direction of the clock signal, and the start pulse signal is inputted to the data input terminal on a first stage of the plurality of driving semiconductor elements with respect to the transfer direction of the data, and the data output terminal on a last stage of the plurality of driving semiconductor elements with respect to the transfer direction of the data is connected to the input terminal on the last stage of the start pulse signal of the plurality of driving semiconductor elements.

Note that, even though the First and Second Embodiments are described based on the group of gate drivers as the display driving device, as noted above, the present invention is also applicable to the group of source drivers. Further, various modifications are obviously possible within the scope of the present invention.

Further, the present invention is not just limited to the liquid crystal driving device and the features of the invention can be exhibited in a system in which a plurality of equivalent semiconductor elements are serially connected and the start pulse signal is transferred in synchronization with the clock signal, and, in particular, in display driving devices in general which are provided with drive circuits in X and Y directions of a two dimensional coordinate and which carries out a display by generating a scan signal based on the start pulse signal and by serially selecting a video signal.

As described, a first display driving device of the present invention includes a plurality of driving semiconductor elements which generate in multiple generation stages a drive signal for a display element for displaying an image, and which are serially connected to one another with respect to input and output terminals of a start pulse signal and a clock signal which are used to generate the drive signal, and the input terminal and the output terminal of the plurality of driving semiconductor elements are interchangeable with respect to each of the start pulse signal and the clock signal, and the plurality of driving semiconductor elements include a transfer circuit for serially transferring a signal to be a source of the drive signal to each of the multiple generation stages by transferring the start pulse signal in a direction from the input terminal to the output terminal in synchronization with the clock signal, wherein the plurality of driving semiconductor elements are provided with the input terminal and the output terminal so that the start pulse signal and the clock signal are transferred in reverse directions with respect to the plurality of driving semiconductor elements which are serially connected to one another, and the input terminal is provided with an input buffer for each of the start pulse signal and the clock signal, and the output terminal is provided with an output buffer for each of the start pulse signal and the clock signal.

In accordance with the invention, the input terminal and the output terminal are selectively provided for their respective start pulse signal and clock signal so that these signals are transferred in opposite directions with respect to the plurality of driving semiconductor elements which are serially connected to one another. Also, the input terminals of the start pulse signal and the clock signal, respectively, are provided with input buffers in accordance with the transfer directions of the respective signals, and the output terminals of the respective signals are provided with output buffers in accordance with the transfer directions of the respective signals.

Thus, when the start pulse signal is transferred to the driving semiconductor element on the following stage, the synchronize clock signal to be used for outputting a signal to be a source of the drive signal precedes the clock signal used in the driving semiconductor element of the preceding stage with respect to the start pulse signal by the phase difference which corresponds to the sum of transfer time of the input buffer of a single stage and the output buffer of a single stage and also to the delay time due to waveform rounding. As a result, the start pulse signal for generating the drive signal is inputted at a correct timing and the liquid crystal module operates correctly.

A second display driving device of the present invention, having the arrangement of the first display driving device, has an arrangement in which the input buffer and the output buffer are input/output buffers whose input and output are interchangeable in accordance with a select signal which is externally supplied.

In accordance with the invention, the input and output buffers of the start pulse signal and the clock signal are used as the input/output buffer whose input and output are interchangeable and which is switched to be the input buffer or output buffer in accordance with the select signal.

Thus, when changing the setting of transfer directions of the start pulse signal and the clock signal, it is not required to go through the troublesome process of separately providing input and output buffers, and it is possible to have various transfer direction modes in the same display driving device.

Further, a third display driving device of the present invention, having the arrangement of the second display driving device, has an arrangement in which the input/output buffer of the start pulse signal and the input/output buffer of the clock signal are switched so that directions of input and output are reversed.

In accordance with the invention, the input/output buffers of the start pulse signal and the clock signal are switched so that the directions of input and output are reversed by a select signal, thus simplifying the circuit structure when the transfer direction of the start pulse signal and the transfer direction of the clock signal are to be reversed.

Further, a fourth display driving device of the present invention, having the arrangement of the first display driving device, has an arrangement in which the plurality of driving semiconductor elements further and each includes a data circuit for directly outputting input data, and a data input terminal and a data output terminal of the data circuit are serially connected to each other so that the data is transferred in a direction of the clock signal, and the start pulse signal is inputted to the data input terminal on a first stage of the plurality of driving semiconductor elements with respect to the transfer direction of the data, and the data output terminal on a last stage of the plurality of driving semiconductor elements with respect to the transfer direction of the data is connected to the input terminal on the last stage of the start pulse signal of the plurality of driving semiconductor elements, and the data input terminal is provided with an input buffer and the data output terminal is provided with an output buffer.

In accordance with the invention, the data circuit for directly outputting data is newly provided in the driving semiconductor element, and the data input terminal and data output terminal, as the input/output terminals of the data, are provided such that the data are transferred in the direction of the clock signal. Further, the data output terminal of the driving semiconductor element on the last stage with respect to the transfer direction of the data is connected to the input terminal of the start pulse signal of the same driving semiconductor element on the last stage.

Thus, when supplying the start pulse signal and the clock signal to the driving semiconductor element from the same circuit, the start pulse signal can be transferred, from the circuit to the input terminal of the start pulse signal of the driving semiconductor element on the last stage, within the driving semiconductor elements which are serially connected to one another without using external wiring but with the wiring of the data circuit. As a result, the area of the substrate can be reduced for the reduced amount of external wiring, and the waveform rounding of the start pulse signal before it is inputted to the input terminal of the driving semiconductor element on the last stage can be reduced, thus reducing the adverse effect of external noise.

Further, a fifth display driving device of the present invention, having the arrangement of the fourth display driving device, has an arrangement in which the input buffer and the output buffer are input/output buffers whose input and output are interchangeable in accordance with a select signal which is externally supplied.

In accordance with the invention the respective input and output buffers of the start pulse signal, clock signal, and data can be used as the input/output buffer whose input and output are interchangeable and which is switched to the input buffer or output buffer by a select signal.

Thus, when changing the setting of transfer directions of the start pulse signal, clock signal, and data, it is not required to go through a troublesome process of separately providing input and output buffers, and it is possible to set various transfer direction modes in the same display driving device.

Further, a sixth display driving device of the present invention, having the arrangement of the fifth display driving device, has an arrangement in which the input/output buffer of the start pulse signal and the input/output buffer of the clock signal are switched so that directions of input and output are reversed, and the input/output buffer of the data and the input/output data of the clock signal are switched so that directions of input and output coincide.

In accordance with the invention, the input/output buffer of the start pulse signal and the input/output buffer of the clock signal are switched by the select signal so that the directions of input and output are reversed, and the input/output buffer of the data and the input/output buffer of the clock signal are switched by the select signal so that the directions of input and output coincide. Thus, because the transfer directions of the start pulse signal and the clock signal are reversed, the circuit structure can be simplified when providing wiring for the data.

Further, a seventh display driving device of the present invention, having the arrangement of any one of the fourth through sixth display driving devices, has an arrangement in which the plurality of driving semiconductor elements are each mounted on a tape carrier package having input side outer lead terminals used for the serial connection and output side outer lead terminals to be connected to the display element, and the data output terminals on a last stage of the plurality of driving semiconductor elements with respect to the transfer direction of the data are shorted by predetermined input side outer lead terminals on the tape carrier package to be connected to the input terminal of the start pulse signal.

In accordance with the invention, each driving semiconductor element is mounted on a tape carrier package, and the driving semiconductor elements are serially connected to one another by the input side outer lead terminals and to the display element by the output side outer lead terminals. On the tape carrier package of the driving semiconductor element on the last stage with respect to the transfer direction of the data, the input side outer lead terminal to be connected to the data output terminal is shorted with the input side outer lead terminal to be connected to the input terminal of the start pulse signal.

In general, the wiring on the tape carrier package is formed altogether by patterning such as etching of a thin metal foil, and the shorted portion of input side outer lead terminals can be made by making continuous wiring from the data output terminal to the input terminal of the start pulse signal in patterning. Thus, the input side outer lead terminal to be connected to the data output terminal and the input side outer lead terminal to be connected to the input terminal of the start pulse signal are not required to be connected to each other by substrate wiring on a step-difference. As a result, broken wires and connection failure can be prevented, thus improving reliability of electrical connection and the efficiency in mass production as a result.

Further, a manufacturing method of a display driving device of the present invention for manufacturing the above display driving devices, includes the steps of forming wiring of the tape carrier package by shorting beforehand predetermined two input side outer lead terminals; and cutting a film so as to maintain the shorted portion of the tape carrier package on which the last stage of the plurality of driving semiconductor elements with respect to the transfer direction of the data is to be mounted, and cutting a film so as not to maintain the shorted portion of the tape carrier package on which other of the plurality of driving semiconductor elements is to be mounted.

In accordance with the invention, when mounting the driving semiconductor element on a tape carrier package to manufacture the above display driving devices, wiring is formed by shorting beforehand predetermined two input side outer lead terminals with respect to all tape carrier packages. Then, a film is cut so as to maintain the shorted portion of the tape carrier package on which the last stage of the plurality of driving semiconductor elements with respect to the transfer direction of the data is to be mounted, and the remaining shorted portion can be used as a shorted portion between the input side outer lead terminal to be connected to the input terminal and the input side outer lead terminal to be connected to the input terminal of the start pulse signal. Further, a film is cut so as not to maintain the shorted portion of the tape carrier package on which other of the plurality of driving semiconductor elements is to be mounted, and predetermined adjacent input side outer lead terminals are electrically separated.

Thus, the same manufacturing steps can be used for all tape carrier packages up until the film cutting step, and the tape carrier package of the last stage and the other tape carrier packages can be separated from each other at the film cutting step, thereby efficiently manufacturing the above display driving devices. Also, even when the arrangement of the input/output terminals of the driving semiconductor elements are altered, the tape carrier package can be manufactured only by changing the shorted portion, thus improving the degree of freedom of the serial connection.

Further, the display driving device of the present invention has an arrangement in which the display element is a liquid crystal panel to which the drive signal is supplied per pixel including a liquid crystal layer.

In accordance with the invention, the display driving device is provided as a group of gate drivers or a group of source drivers for driving pixels on the liquid crystal panel, thus accurately driving the liquid crystal panel.

Further, the liquid crystal module of the present invention includes the above display driving devices.

In accordance with the invention, by having the above display driving devices, it is possible to provide a highly reliable liquid crystal module capable of accurately driving the liquid crystal panel.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A method for manufacturing a display driving device which includes a plurality of driving semiconductor elements which generate in multiple generation stages a drive signal for a display element for displaying an image, and which are serially connected to one another with respect to input and output terminals of a start pulse signal and a clock signal which are used to generate the drive signal, the plurality of drive semiconductor elements having a transfer circuit for serially transferring a signal to be a source of the drive signal to each of the multiple generation stages by transferring the start pulse signal in a direction from the input terminal to the output terminal in synchronization with the clock signal, and the plurality of driving semiconductor elements being provided with the input terminal and the output terminal so that the start pulse signal and the clock signal are transferred in reverse directions with respect to the plurality of driving semiconductor elements which are serially connected to one another, the plurality of driving semiconductor elements further and each including a data circuit for directly outputting input data, a data input terminal and a data output terminal of the data circuit being serially connected to each other so that the data is transferred in a direction of the clock signal, and the start pulse signal being inputted to the data input terminal on a first stage of the plurality of driving semiconductor elements with respect to the transfer direction of the data, and the data output terminal on a last stage of the plurality of driving semiconductor elements with respect to the transfer direction of the data being connected to the input terminal of the start pulse signal on the last stage of the plurality of driving semiconductor elements, the plurality of driving semiconductor elements each being mounted on a tape carrier package having input side outer lead terminals used for the serial connection and output side outer lead terminals to be connected to the display element, and the data output terminals on a last stage of the plurality of driving semiconductor elements with respect to the transfer direction of the data being shorted by predetermined input side outer lead terminals on the tape carrier package, said method comprising the steps of:

forming wiring of the tape carrier package by shorting beforehand predetermined two input side outer lead terminals; and cutting a film so as to maintain the shorted portion of the tape carrier package on which the last stage of the plurality of driving semiconductor elements with respect to the transfer direction of the data is to be mounted, and cutting a film so as not to maintain the shorted portion of the tape carrier package on which other of the plurality of driving semiconductor elements is to be mounted.

2. A display driving device, comprising:

a plurality of driving semiconductor elements which generate in multiple generation stages a drive signal for a display element for displaying an image, and which are serially connected to one another with respect to input and output terminals of a start pulse signal and a clock signal which are used to generate the drive signal, said plurality of drive semiconductor elements having a transfer circuit for serially transferring a signal to be a source of the drive signal to each of the multiple generation stages by transferring the start pulse signal in a direction from the input terminal to the output terminal in synchronization with the clock signal, and said plurality of driving semiconductor elements being provided with the input terminal and the output terminal so that the start pulse signal and the clock signal are transferred in reverse directions with respect to said plurality of driving semiconductor elements which are serially connected to one another, wherein the display element is a liquid crystal panel and the drive signal is supplied per pixel including a liquid crystal layer.

3. The display driving device as set forth in claim 2, wherein the input terminal and the output terminal of said plurality of driving semiconductor elements are interchangeable with respect to each of the start pulse signal and the clock signal, and the input terminal is provided with an input buffer for each of the start pulse signal and the clock signal, and the output terminal is provided with an output buffer for each of the start pulse signal and the clock signal.

4. The display driving device as set forth in claim 3, wherein the input buffer and the output buffer are input/output buffers whose input and output are interchangeable in accordance with a select signal which is externally supplied.

5. The display driving device as set forth in claim 3, wherein the input/output buffer of the start pulse signal and the input/output buffer of the clock signal are switched so that directions of input and output are reversed.

6. The display driving device as set forth in claim 2, wherein said plurality of driving semiconductor elements further and each includes a data circuit for directly outputting input data, and a data input terminal and a data output terminal of the data circuit are serially connected to each other so that the data is transferred in a direction of the clock signal, and the start pulse signal is inputted to the data input terminal on a first stage of said plurality of driving semiconductor elements with respect to the transfer direction of the data, and the data output terminal on a last stage of said plurality of driving semiconductor elements with respect to the transfer direction of the data is connected to the input terminal on the last stage of the start pulse signal of said plurality of driving semiconductor elements.

7. The display driving device as set forth in claim 6, wherein the data input terminal is provided with an input buffer and the data output terminal is provided with an output buffer.

8. The display driving device as set forth in claim 7, wherein the input buffer and the output buffer are input/output buffers whose input and output are interchangeable in accordance with a select signal which is externally supplied.

9. The display driving device as set forth in claim 8, wherein the input/output buffer of the start pulse signal and the input/output buffer of the clock signal are switched so that directions of input and output are reversed, and the input/output buffer of the data and the input/output data of the clock signal are switched so that directions of input and output coincide.

10. The display driving device as set forth in claim 6, wherein said plurality of driving semiconductor elements are each mounted on a tape carrier package having input side outer lead terminals used for the serial connection and output side outer lead terminals to be connected to the display element, and the data output terminals on a last stage of the plurality of driving semiconductor elements with respect to the transfer direction of the data are shorted by predetermined input side outer lead terminals on the tape carrier package.

11. A liquid crystal module including:

a display driving device which includes a plurality of driving semiconductor elements which generate in multiple generation stages a drive signal for a display element for displaying an image, and which are serially connected to one another with respect to input and output terminals of a start pulse signal and a clock signal which are used to generate the drive signal, said plurality of drive semiconductor elements having a transfer circuit for serially transferring a signal to be a source of the drive signal to each of the multiple generation stages by transferring the start pulse signal in a direction from the input terminal to the output terminal in synchronization with the clock signal, said plurality of driving semiconductor elements being provided with the input terminal and the output terminal so that the start pulse signal and the clock signal are transferred in reverse directions, with respect to said plurality of driving semiconductor elements which are serially connected to one another, wherein the input terminals and output terminals can be switched to have an input or output function, and wherein the display element is a liquid crystal panel and the drive signal is supplied per pixel including a liquid crystal layer.

12. A method for manufacturing a display driving device which includes a plurality of driving semiconductor elements which generate in multiple generation stages a drive signal for a display element for displaying an image, and which are serially connected to one another with respect to input and output terminals of a start pulse signal and a clock signal which are used to generate the drive signal, the input terminal and the output terminal of said plurality of driving semiconductor elements being interchangeable with respect to each of the start pulse signal and the clock signal, the plurality of driving semiconductor elements including a transfer circuit for serially transferring a signal to be a source of the drive signal to each of the multiple generation stages by transferring the start pulse signal in a direction from the input terminal to the output terminal in synchronization with the clock signal, and said plurality of driving semiconductor elements being provided with the input terminal and the output terminal so that the start pulse signal and the clock signal are transferred in reverse directions with respect to said plurality of driving semiconductor elements which are serially connected to one another, and the input terminal being provided with an input buffer for each of the start pulse signal and the clock signal, and the output terminal being provided with an output buffer for each of the start pulse signal and the clock signal, said plurality of driving semiconductor elements further and each including a data circuit for directly outputting input data, and a data input terminal and a data output terminal of the data circuit being serially connected to each other so that the data is transferred in a direction of the clock signal, and the start pulse signal being inputted to the data input terminal on a first stage of said plurality of driving semiconductor elements with respect to the transfer direction of the data, and the data output terminal on a last stage of said plurality of driving semiconductor elements with respect to the transfer direction of the data being connected to the input terminal of the start pulse signal on the last stage of said plurality of driving semiconductor elements, and the data input terminal being provided with an input buffer and the data output terminal being provided with an output buffer, and said plurality of driving semiconductor elements each being mounted on a tape carrier package having input side outer lead terminals used for the serial connection and output side outer lead terminals to be connected to the display device, and the data output terminals on a last stage of the plurality of driving semiconductor elements with respect to the transfer direction of the data being shorted by predetermined input side outer lead terminals on the tape carrier package to be connected to the input terminal of the start pulse signal, said method comprising the steps of:

forming wiring of the tape carrier package by shorting beforehand predetermined two input side outer lead terminals; and cutting a film so as to maintain the shorted portion of the tape carrier package on which the last stage of the plurality of driving semiconductor elements with respect to the transfer direction of the data is to be mounted, and cutting a film so as not to maintain the shorted portion of the tape carrier package on which other of the plurality of driving semiconductor elements is to be mounted.

13. A display driving device, comprising:

a plurality of driving semiconductor elements which generate in multiple generation stages a drive signal for a display element for displaying an image, and which are serially connected to one another with respect to input and output terminals of a start pulse signal and a clock signal which are used to generate the drive signal, and said plurality of driving semiconductor elements having an input terminal and an output terminal which are interchangeable with respect to each of the start pulse signal and the output signal, said plurality of driving semiconductor elements each including a transfer circuit for serially outputting a signal to be used as a source to generate the drive signal to each of the multiple generation stages by transferring the start pulse signal in a direction from the input terminal to the output terminal in synchronization with the clock signal, and said plurality of semiconductor elements being provided with the input terminal and the output terminal so that the start pulse signal and the clock signal are transferred in reverse directions, and the input terminal and the output terminal being provided with an input buffer and an output buffer, respectively, for each of the start pulse signal and the clock signal, wherein the display element is a liquid crystal panel and the drive signal is supplied per pixel including a liquid crystal layer.

14. A liquid crystal module including:

a display driving device which includes a plurality of driving semiconductor elements which generate in multiple generation stages a drive signal for a display element for displaying an image, and which are serially connected to one another with respect to input and output terminals of a start pulse signal and a clock signal which are used to generate the drive signal, the input terminal and the output terminal of said plurality of driving semiconductor elements being interchangeable with respect to each of the start pulse signal and the clock signal, the plurality of driving semiconductor elements including a transfer circuit for serially transferring a signal to be a source of the drive signal to each of the multiple generation stages by transferring the start pulse signal in a direction from the input terminal to the output terminal in synchronization with the clock signal, and said plurality of driving semiconductor elements being provided with the input terminal and the output terminal so that the start pulse signal and the clock signal are transferred in reverse directions, with respect to said plurality of driving semiconductor elements which are serially connected to one another, wherein the input terminals and output terminals can be switched to have an input or output function, and the input terminal being provided with an input buffer for each of the start pulse signal and the clock signal, and the output terminal being provided with an output buffer for each of the start pulse signal and the clock signal, wherein the display element is a liquid crystal panel and the drive signal is supplied per pixel including a liquid crystal layer.

15. The display driving device as set forth in claim 13, wherein the input buffer and the output buffer are input/output buffers whose input and output are interchangeable in accordance with a select signal which is externally supplied.

16. The display driving device as set forth in claim 15, wherein the input/output buffer of the start pulse signal and the input/output buffer of the clock signal are switched so that directions of input and output are reversed.

17. The display driving device as set forth in claim 13, wherein said plurality of driving semiconductor elements further and each includes a data circuit for directly outputting input data, and a data input terminal and a data output terminal of the data circuit are serially connected to each other so that the data is transferred in a direction of the clock signal, and the start pulse signal is inputted to the data input terminal on a first stage of said plurality of driving semiconductor elements with respect to the transfer direction of the data, and the data output terminal on a last stage of said plurality of driving semiconductor elements with respect to the transfer direction of the data is connected to the input terminal of the start pulse signal on the last stage of said plurality of driving semiconductor elements, and the data input terminal and the data output terminal are provided with an input buffer and an output buffer, respectively.

18. The display driving device as set forth in claim 17, wherein the input buffer and the output buffer are input/ output buffers whose input and output are interchangeable in accordance with a select signal which is externally supplied.

19. The display driving device as set forth in claim 18, wherein the input/output buffer of the start pulse signal and the input/output buffer of the clock signal are switched so that directions of input and output are reversed, and the input/output buffer of the data and the input/output data of the clock signal are switched so that directions of input and output coincide.

20. The display driving device as set forth in claim 17, wherein said plurality of driving semiconductor elements are each mounted on a tape carrier package having input side outer lead terminals used for the serial connection and output side outer lead terminals to be connected to the display device, and the data output terminals on a last stage of the plurality of driving semiconductor elements with respect to the transfer direction of the data are shorted by predetermined input side outer lead terminals on the tape carrier package to be connected to the input terminal of the start pulse signal.

21. The display driving device as set forth in claim 18, wherein said plurality of driving semiconductor elements are each mounted on a tape carrier package having input side outer lead terminals used for the serial connection and output side outer lead terminals to be connected to the display device, and the data output terminals on a last stage of the plurality of driving semiconductor elements with respect to the transfer direction of the data are shorted by predetermined input side outer lead terminals on the tape carrier package to be connected to the input terminal of the start pulse signal.

22. The display driving device as set forth in claim 19, wherein said plurality of driving semiconductor elements are each mounted on a tape carrier package having input side outer lead terminals used for the serial connection and output side outer lead terminals to be connected to the display device, and the data output terminals on a last stage of the plurality of driving semiconductor elements with respect to the transfer direction of the data are shorted by predetermined input side outer lead terminals on the tape carrier package to be connected to the input terminal of the start pulse signal.

23. A liquid crystal module including:

a display driving device which includes a plurality of driving semiconductor elements which generate in multiple generation stages a drive signal for a display element for displaying an image, and which are serially connected to one another with respect to input and output terminals of a start pulse signal and a clock signal which are used to generate the drive signal, said plurality of drive semiconductor elements having a transfer circuit for serially transferring a signal to be a source of the drive signal to each of the multiple generation stages by transferring the start pulse signal in a direction from the input terminal to the output terminal in synchronization with the clock signal, said plurality of driving semiconductor elements being provided with the input terminal and the output terminal so that the start pulse signal and the clock signal are transferred in reverse directions, with respect to said plurality of driving semiconductor elements which are serially connected to one another, wherein the input terminals and output terminals can be switched to have an input or output function, said plurality of driving semiconductor elements each being mounted on a tape carrier package having input side outer lead terminals used for the serial connection and output side outer lead terminals to be connected to the display element, and the data terminals on a last stage of the plurality of driving semiconductor elements with respect to the transfer direction of the data being shorted by predetermined input side outer lead terminals on the tape carrier package to be connected to the input terminal of the start pulse signal, and wherein the display element is a liquid crystal panel and the drive signal is supplied per pixel including a liquid crystal layer.

24. A liquid crystal module including a display driving device which includes:

a plurality of driving semiconductor elements which generate in multiple generation stages a drive signal for a display element for displaying an image, and which are serially connected to one another with respect to input and output terminals of a start pulse signal and a clock signal which are used to generate the drive signal, the input terminal and the output terminal of said plurality of driving semiconductor elements being interchangeable with respect to each of the start pulse signal and the clock signal, the plurality of driving semiconductor elements including a transfer circuit for serially transferring a signal to be a source of the drive signal to each of the multiple generation stages by transferring the start pulse signal in a direction from the input terminal to the output terminal in synchronization with the clock signal, the plurality of driving semiconductor elements being provided with the input terminal and the output terminal so that the start pulse signal and the clock signal are transferred in reverse directions, with respect to said plurality of driving semiconductor elements which are serially connected to one another, wherein the input terminals and output terminals can be switched to have an input or output function, the plurality of driving semiconductor elements each being mounted on a tape carrier package having input side outer lead terminals used for the serial connection and output side outer lead terminals to be connected to the display element, and the data terminals on a last stage of the plurality of driving semiconductor elements with respect to the transfer direction of the data being shorted by predetermined input side outer lead terminals on the tape carrier package to be connected to the input terminal of the start pulse signal, and the input terminal being provided with an input buffer for each of the start pulse signal and the clock signal, and the output terminal being provided with an output buffer for each of the start pulse signal and the clock signal, wherein the display element is a liquid crystal panel and the drive signal is supplied per pixel including a liquid crystal layer.

* * * * *